US011576539B2

(12) United States Patent
Yoo et al.

(10) Patent No.: US 11,576,539 B2
(45) Date of Patent: Feb. 14, 2023

(54) DRYING APPARATUS AND RELATED METHODS

(71) Applicant: LG ELECTRONICS INC., Seoul (KR)

(72) Inventors: Hyun sun Yoo, Seoul (KR); Seung Yup Lee, Seoul (KR); Sang Yoon Lee, Seoul (KR); Byung Soo Oh, Seoul (KR); Hyun-Joo Jeon, Seoul (KR); So Ra Cheon, Seoul (KR); Ji sun Yoon, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 249 days.

(21) Appl. No.: 17/014,676

(22) Filed: Sep. 8, 2020

(65) Prior Publication Data

US 2021/0290001 A1 Sep. 23, 2021

Related U.S. Application Data

(60) Provisional application No. 62/992,138, filed on Mar. 19, 2020.

(30) Foreign Application Priority Data

Apr. 29, 2020 (KR) ..... 10-2020-0052544

(51) Int. Cl.
*A47K 10/48* (2006.01)
*F26B 21/00* (2006.01)

(52) U.S. Cl.
CPC ..... *A47K 10/48* (2013.01); *F26B 21/001* (2013.01); *F26B 21/003* (2013.01); *F26B 21/004* (2013.01)

(58) Field of Classification Search
CPC .... F26B 21/001; F26B 21/003; F26B 21/004; A47K 10/48
USPC ..... 34/90
See application file for complete search history.

(56) References Cited

U.S. PATENT DOCUMENTS 3,449,838 A * 6/1969 Chancellor, Jr. ..... A45D 20/16 34/233
3,621,199 A * 11/1971 Goldstein ..... A61F 7/0085 165/126
3,878,621 A * 4/1975 Duerre ..... A45D 20/16 392/363
4,780,595 A * 10/1988 Alban ..... A47K 10/48 392/364
D311,070 S * 10/1990 Blevins ..... D28/54.1
4,961,272 A * 10/1990 Lee ..... A47K 10/48 34/239
5,651,189 A * 7/1997 Coykendall ..... F26B 21/001 34/91
6,067,725 A * 5/2000 Moser ..... A47K 10/48 34/223
8,438,753 B2 * 5/2013 Martin ..... F26B 5/00 236/94

(Continued)

*Primary Examiner* — Stephen M Gravini
(74) *Attorney, Agent, or Firm* — Dentons US LLP

(57) ABSTRACT

A drying arrangement includes a primary drying module having: a body, a bar movable relative to the body, the bar having an air outlet for exhausting an airflow in a first airflow direction; and a secondary drying module having a housing, the housing having an air outlet for exhausting an airflow in a second airflow direction; wherein the first airflow direction and the second airflow direction differ from one another.

20 Claims, 49 Drawing Sheets

(56) References Cited

U.S. PATENT DOCUMENTS

| | | | | |
|---|---|---|---|---|
| 10,136,771 | B1 * | 11/2018 | Dykes | A61H 33/063 |
| 2021/0289998 | A1 * | 9/2021 | Yoo | F24H 3/0405 |
| 2021/0290001 | A1 * | 9/2021 | Yoo | A47K 10/48 |
| 2022/0061601 | A1 * | 3/2022 | Kim | A45D 20/16 |
| 2022/0061602 | A1 * | 3/2022 | An | A47K 10/48 |
| 2022/0061603 | A1 * | 3/2022 | An | A47K 10/48 |
| 2022/0061604 | A1 * | 3/2022 | Kim | F26B 21/02 |
| 2022/0061605 | A1 * | 3/2022 | Kim | A47K 10/48 |
| 2022/0079397 | A1 * | 3/2022 | An | A47K 10/48 |
| 2022/0214107 | A1 * | 7/2022 | Newman | F26B 21/004 |

* cited by examiner

DRYING APPARATUS AND RELATED METHODS

This application claims the benefit and priority to U.S. Provisional Application No. 62/992,138, filed on Mar. 19, 2020, and Korean Application No. 10-2020-0052544, filed on Apr. 29, 2020, all of which are hereby incorporated by reference in their entirety for all purposes as if fully set forth herein.

FIELD OF THE DISCLOSURE

The present disclosure relates to drying apparatuses, arrangements and methods of drying, and more particularly, but not solely, to apparatuses for drying of a person or parts of the person.

BACKGROUND

In this specification where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

Regular showering or bathing are commonplace activities across modern society. In many cultures, a shower bath is taken on a daily basis. People may even wash more than once a day, for example, where they have done some form of exercise during the day.

As a result of washing, or also due to perspiration, a person may become wet. Drying of this moisture is important to a person's health in order to prevent bacterial and fungal growth on the person.

Given the right environment, such moisture may evaporate away on its own, but for expediency and comfort, most people towel themselves dry following washing or exercise. Toweling can be a good way to remove water from a person, but drying effectively to prevent bacterial and fungal growth—particularly around the feet—can be time consuming thus such areas may commonly be inadequately dried. Towel drying of hair, particularly for those with long hair, can additionally be a frustrating and involved process.

Aside from any issues with the use of towels to desirably dry a person, the number towels used and frequency of their use means that towels account for a significant proportion of total laundry loads. This is particularly the case in settings where towels are only used once, such as in gyms, sports clubs, and commonly in hotels.

Laundering of towels is energy intensive, and consumption of fresh water is also of concern from an environmental point of view. The depletion of fresh water resources is known to be a widespread issue across many parts of the world. The number of towels washed and frequency with which they are commonly washed consumes significant amounts of water resources.

It is desired to address or ameliorate one or more of the problems discussed above by providing a drying apparatus to at least provide the public with a useful alternative While certain aspects of conventional technologies have been discussed to facilitate the disclosure, Applicants in no way disclaim these technical aspects, and it is contemplated that the claimed invention may encompass or include one or more of the conventional technical aspects discussed herein.

SUMMARY

The present disclosure seeks to address one or more of the above-mentioned issues by providing apparatus, arrangements and methods that improve health and hygiene, as well as have a positive impact on the environment. For instance, the apparatus, arrangements and methods of the present disclosure provide for the efficient and effective drying of the person, or parts of the person, that diminishes or eliminates reliance upon towels.

It should be understood that, unless expressly stated otherwise, the claimed invention comprehends any and all combinations of the individual features, arrangements and/or steps detailed herein, including but not limited to those features, arrangements and/or steps set forth in the appended claims.

A drying arrangement for drying a body of a person, the drying arrangement comprising:

- a primary drying module comprising:
  - a body;
  - a bar movable relative to the body, the bar comprising an air outlet;
  - a first air inlet;
  - a first flow generator to receive inlet air from the first air inlet and generate a primary airflow;
  - wherein the primary airflow is exhausted from the bar air outlet; and
- a secondary drying module comprising:
  - a housing;
  - a second air inlet;
  - a second flow generator to receive inlet air from the second air inlet and generate a secondary airflow; and
  - a second air outlet in the housing for exhausting the secondary airflow from the second flow generator,
  - wherein the primary drying module and the secondary drying module are configured such that, with respect to the body of the person using the drying system, the primary airflow from the bar air outlet of the primary drying module and the secondary airflow from the second air outlet of the secondary drying module each:
- originate from different positions about a lateral periphery of the body of the person, and
- are able to be directed towards a common longitudinal axis of the body of the person.

As used herein the term "and/or" means "and" or "or," or both.

As used herein "(s)" following a noun means the plural and/or singular forms of the noun.

For the purposes of this specification, the term "plastic" shall be construed to mean a general term for a wide range of synthetic or semisynthetic polymerization products, and includes hydrocarbon-based polymer(s).

For the purpose of this specification, where method steps are described in sequence, the sequence does not necessarily mean that the steps are to be chronologically ordered in that sequence, unless there is no other logical manner of interpreting the sequence, or expressly stated. Notwithstanding this, the present invention also encompasses, in the alternative, carrying out the steps of the methods described here in the specific sequence or order that they are presented in the present specification and/or claims.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

Other aspects of the embodiments of the invention may become apparent from the following description which is given by way of example only and with reference to the accompanying drawings.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

Preferred embodiments or aspects of the invention will be described by way of example only and with reference to the drawings, in which.

DETAILED DESCRIPTION OF PREFERRED EMBODIMENTS

Reference is made in detail to one or more embodiments of the present invention, examples of which are illustrated in the accompanying drawings.

A drying apparatus and/or drying arrangement may be provided according to the disclosure for a range of applications. In at least a primary application, the drying apparatus may be a dryer for drying a person, such as following bathing or showering. The drying apparatus may be provided as a supplement to towel drying, or in various preferred forms may be provided as a substitute for towel drying. By the use of the drying apparatus as a body dryer, a person may present themselves and be dried by one or more forced airflows of the drying apparatus. Further, the drying apparatus and/or arrangement can be used to adjust, and ideally to optimize, the environmental conditions in the surrounding space within which it is located. For instance, the drying apparatus and/or arrangement can be used to alter one or more environmental components such as humidity and/or temperature.

Figure 1:
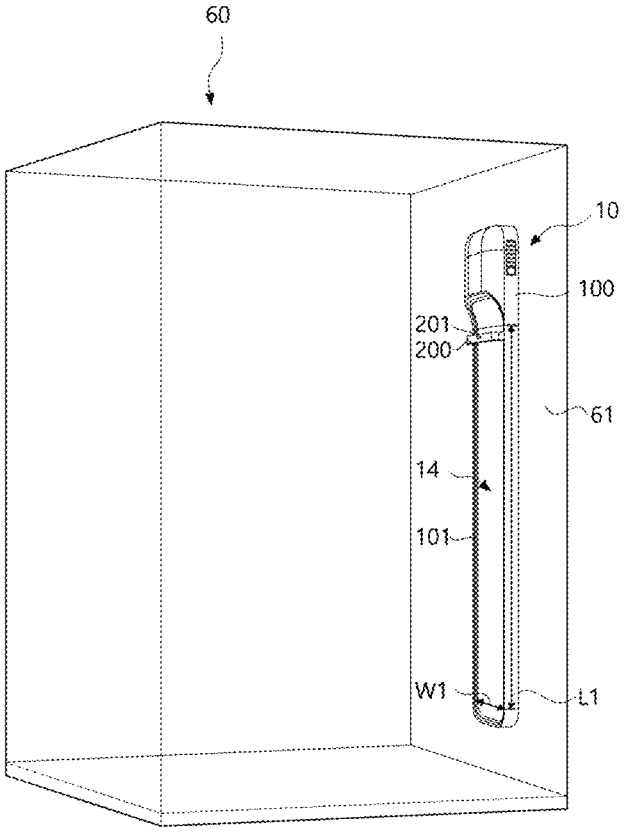
FIG. 1 is a perspective view of a drying arrangement according to one embodiment.

FIG. 1 is a perspective view of a drying apparatus according to an embodiment of the present invention. Referring to FIG. 1, a drying apparatus 10 may comprise a body 100 and a bar 200. While the term "bar" is used, "bar" should not be construed as being limited to a bar shape but may have various kinds of shapes according a design criteria or an intended result. The bar 200 may be supported by the body 100, and may be moveable relative to the body 100. The bar 200 may be driven relative to the body 100 by a drive apparatus, as will be explained in greater detail herein.

The drying apparatus 10 may be sized so as to correspond to human body dimensions. For example, in the configuration of the drying apparatus as shown in FIG. 1, the drying apparatus 10, and in particular the body 100, may be sized in proportion to human body dimensions to enable the delivery of the forced airflow across the human body. The drying apparatus 10 can be made available in different sizes (i.e. longitudinal lengths L1 and/or lateral widths W1) having different dimensions such that a prospective user can select a desired size of drying apparatus 10, for example, by selecting a size that most closely corresponds to the size, shape and dimensions of the user's body.

The forced airflow may be provided through a first air outlet 101 distributed along at least a portion of a periphery of a drying face 14 of the body 100. The forced airflow may also be provided through a second air outlet 201 located at the bar 200. Unlike the first air outlet 101 which is stationary with respect to the body 100, the second air outlet 201 can be moveable, and the bar 200 can travel along a longitudinal length L1 of the body 100 as indicated by the vertical double headed arrow of FIG. 1 to expel forced airflow to different parts of the human body. In other words, the bar 200 can travel in the upward or downward directions, as indicated by the vertical double headed arrow, while traversing all or a portion of the longitudinal length L1. According to certain embodiments, the distance traveled by the bar 200 along the longitudinal length L1 of the body 100 can be set and/or adjusted to correspond to a desired extent of a user's body.

The body 100 may define a drying side or face 14 adjacent to which a user may present themselves for drying by the drying apparatus 10. The drying face 14 may generally define a face or plane from which the forced airflow is provided by the drying apparatus 10 through the first air outlet 101 and/or the second air outlet 201.

As further illustrated in FIG. 1, the drying apparatus 10 may be associated with one or more surfaces. The one or more surfaces may be associated with a structure or enclosure 60. According to certain embodiments, the drying apparatus 10 can be mounted to a surface such as a surface of a wall 61 associated with a structure or enclosure 60. The drying apparatus 10 can be dimensioned, and mounted at a location on the surface or wall 61, such that it approximately corresponds with the upper and lower bounds of the height of a person using the drying apparatus 10. The structure or enclosure 60 can comprise one or a plurality of surfaces or walls. According to certain nonlimiting embodiments, the structure or enclosure 60 can optionally comprise one or more of surfaces associated with: one or more walls; a door; a floor; a ceiling; or any combination thereof.

Figure 2:
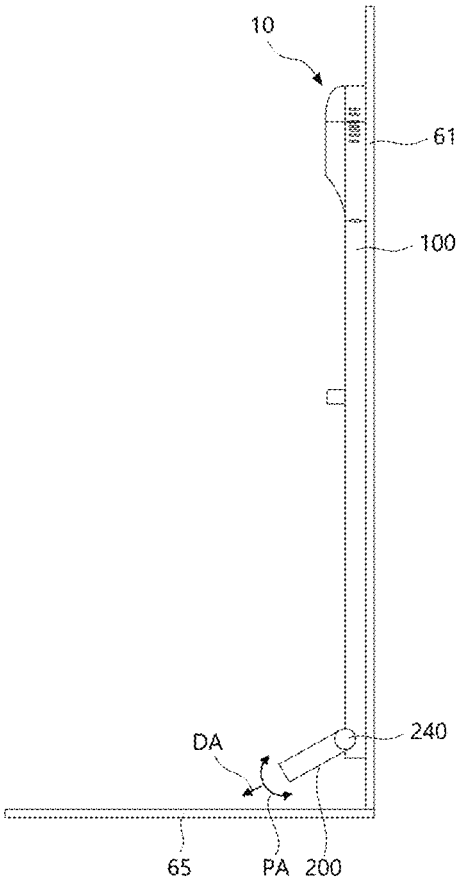
FIG. 2 is a side view of a drying arrangement according to another embodiment.

The direction of airflow emitted from the second air outlet 201 of the bar 200 may also be manually and/or automatically adjusted according to further optional embodiments. For example, as illustrated in FIG. 2, the bar 200 can be mounted to the body via a pivot 240, so that the bar 200 and its associated air outlet 201 can be positioned at a pivoted angle (PA), and reoriented either upwards or downwards, as indicated by the double headed arrow PA of FIG. 2. Thus, as illustrated in FIG. 2, a directed airflow DA can be aimed and reach areas that do not correspond directly to the relative longitudinal location along the body 100. For example, the directed airflow DA can be aimed at the lower extremities of a user's body, such as the feet or lower leg area, and/or directed to a floor 65 of the structure or enclosure 60. Although not specifically illustrated in FIG. 2, it should be evident that the bar can also be pivoted in the opposite direction, or angled upward toward upper extremities of a user's body, or portions of a wall or ceiling associated with the structure or enclosure 60. The pivot 240 can be formed by any suitable mechanical, electromechanical, electromagnetic, pneumatic, or other alternative structure, so long as the desired repositioning or direction of the airflow emitted from the bar 200 can be achieved. As previously noted, the bar 20 can be moved via the pivot 240 either manually, or the movement can be driven by a suitable drive apparatus, or by either modes of movement in conjunction with one another or in the alternative.

Figure 3:
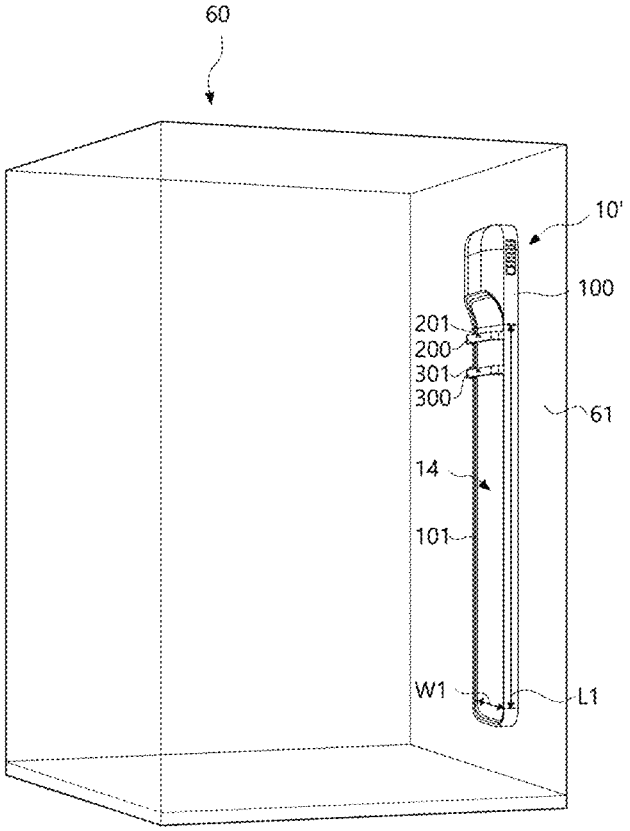
FIG. 3 is a perspective view of a further embodiment of a drying arrangement.

FIG. 3 illustrates a drying apparatus 10' constructed according to an alternative embodiment. The drying apparatus 10' possesses all of the same features and functionality of the drying apparatus 10 described herein, but includes a plurality of movable bars (200, 300). Thus, according to the illustrated embodiment, a second movable bar 300 with an associated air outlet 301 is provided. In this regard, the second bar 300 can optionally be movable along the longitudinal direction L1 relative to the body 100. According to a further optional embodiment, the second bar 300 is relatively movable along the longitudinal direction L1 with respect to the movement of the first bar 200. In other words, longitudinal movement of the first and second bars 200, 300 relative to the body 100 can be synchronized. Alternatively, the longitudinal movement of the first and second bars 200, 300 relative to the body 100 can be independent from one another. As alluded to above, the second bar 300 can also be mounted to the body 100 via a pivot 240, having those features and functionality previously described herein. The pivot used to attach the second bar 300 can have the same construction as the pivot 240 used to attach the first bar to the body. Alternatively, the pivots used to connect the first and second bars 200, 300 can be provided by different constructions and/or mechanisms. The pivoting movement of the first and second bars 200, 300 can also be synchronized, or independent, relative to one another.

Figure 4:
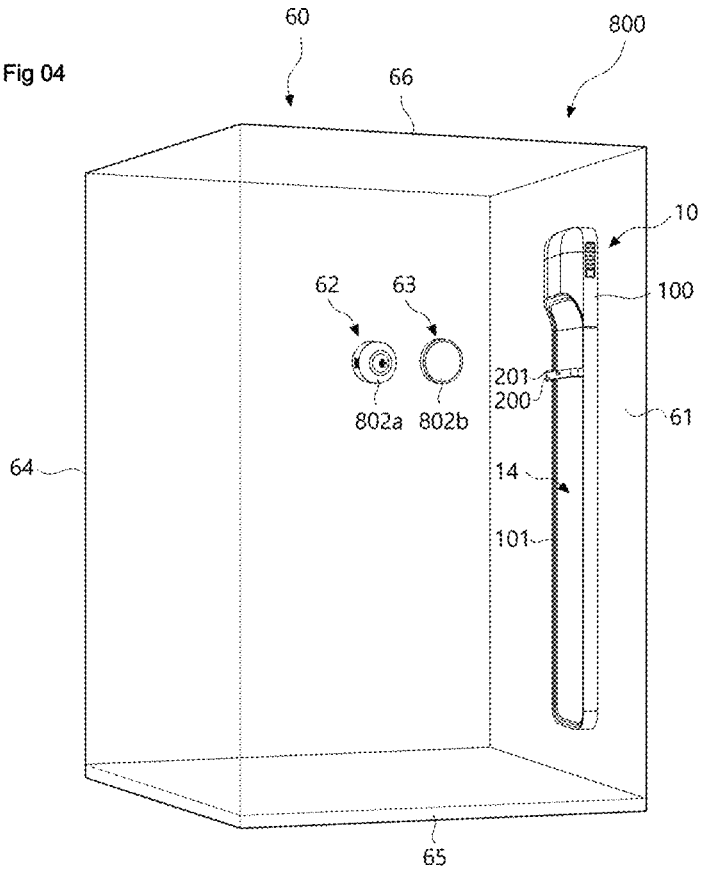
FIG. 4 is a perspective view of another embodiment of a drying arrangement.

FIG. 4 is an illustration of a distributed drying arrangement 800 formed according to certain embodiments. The distributed drying arrangement 800 can be formed from a plurality of drying components or drying modules. According to the embodiment illustrated in FIG. 4, the arrangement 800 includes a primary drying module 801, and one or more secondary drying modules (e.g., 802*a*, 802*b*). The primary drying module 801 and the one or more secondary drying modules 802*a*, 802*b* can be configured and arranged to exhaust air flows in different directions relative to one another. When a plurality of secondary drying modules are provided, at least two of the secondary drying modules can be arranged so that airflow exhausted from each secondary drying module flows in different directions. For example, secondary modules 802*a*, 802*b* can be arranged in opposition to one another, as illustrated in FIG. 4.

The distributed drying arrangement 800 can be associated with various surfaces according to certain alternative embodiments. For example, as illustrated in FIG. 4, the various modules (e.g., 801, 802*a*, 802*b*) can be associated with respective walls or surfaces (e.g., 61, 62, 63, 64, 65, 66) of a structure or enclosure 60. However, it should be clear that the modules of the drying arrangement 800 can be positioned and arranged relative to one another by a number of different alternative mechanisms, such as by hanging, the use of stands, etc.

Figure 5:
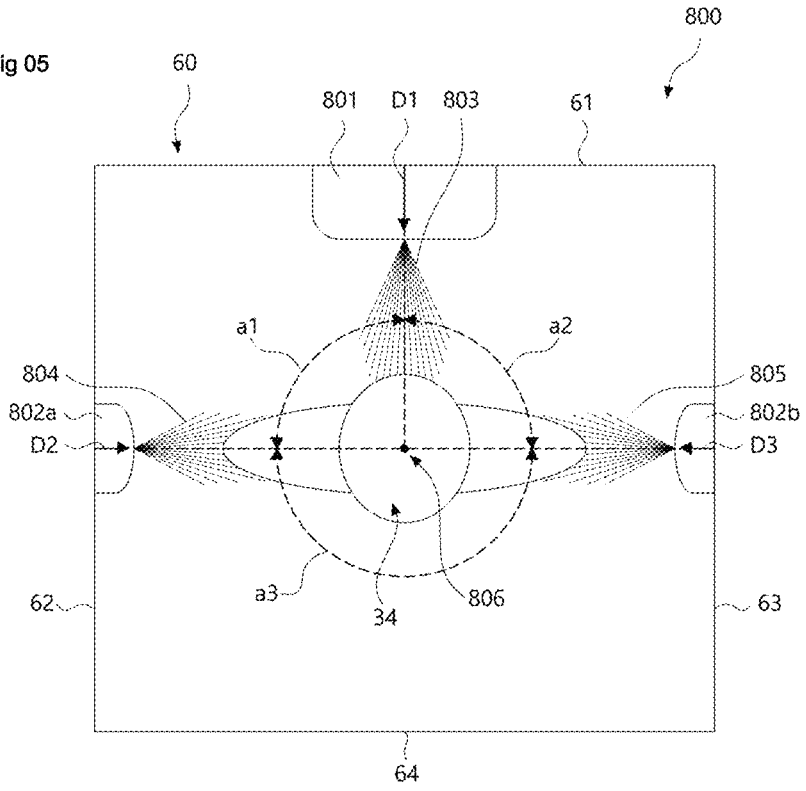
FIG. 5 is a top view of a schematic illustration of still another embodiment of a drying arrangement.

FIG. 5 is a top down schematic view of a distributed drying arrangement 800 according to optional embodiments. The primary drying module 801 has an air outlet (e.g., 201), and is otherwise configured and arranged to exhaust an airflow 803 therefrom in a first airflow direction D1. Likewise, each of the one or more secondary drying modules 802*a* and/or 802*b* have an air outlet (e.g., 811, FIG. 7A), and are otherwise configured and arranged to exhaust an airflow therefrom (804, 805) in a second airflow direction D2 and/or a third airflow direction D3, respectively. As illustrated in FIG. 5, the airflow direction D1 exhausted from the primary drying module 801 differs from the airflow direction D2 and/or D3 exhausted from the one or more secondary drying modules 802*a* and/or 802*b*.

Generally speaking, the distributed drying arrangement 800 can be constructed and arranged such that the airflow direction of the primary drying module can form an angle relative to the airflow direction of the one or more secondary drying modules. Also, when more than one secondary drying modules are provided, the airflow directions of the secondary drying modules can form one or more angles relative to one another. These angles can vary within any suitable range. For example, the angular relationship between airflows described herein can range from greater than 0° to 180° (>0° to 180°). For example, according to the nonlimiting illustrative embodiment of FIG. 5, the airflow direction D1 associated with the primary drying module 801 can form an angle a1 with the airflow direction D2 associated with secondary drying module 802*a* of about 90°. The airflow direction D1 associated with the primary drying module 801 can form an angle a2 with the airflow direction D3 associated with the secondary drying module 802*b* of about 90°. The airflow direction D2 associated with the secondary drying module 802*a* can form an angle a3 with the airflow direction D3 associated with the secondary drying module 802*b* of about 180°. Again, the relative positions of the primary and secondary drying modules and their associated airflow directions, as well as the relative angles therebetween, can vary according to the principles of the present invention as set forth herein.

As further illustrated in FIG. 5, according to further embodiments, a person 34 is shown in top-down view, optionally located within a structure or enclosure 60, being contacted by the drying airflows. The longitudinal axis 806 of the person 34 is directed into the page in FIG. 5. The drying modules can be positioned at different locations relative to the user, the airflows emitted from each module come from different directions (e.g., D1, D2, D3) and form different angles relative to one another (e.g., a1, a2, a3). For example, as illustrated in FIG. 5, the airflows 803, 804, and 805 are incident upon the person 34 from different angles, and are all directed towards the common longitudinal axis 806. According to certain optional embodiments, the primary drying module 801 can be located on the first wall 61, and the secondary drying modules 802*a* and 802*b* can be located on a respective second wall 62 and third wall 63. It is further contemplated that primary and/or secondary drying modules can be associated with other or additional walls and surfaces, beyond that contained in the illustrated embodiments. For example, according to one alternative, one or more secondary drying module may be arranged coincident with, or on, wall 64.

The airflows 803, 804 and 805 may be fixed, such as in the optional configuration illustrated in FIG. 5, or alternatively may be movable such that the position of one or more of the airflows 803, 804 and 805 can be adjusted or reoriented.

Figure 6:
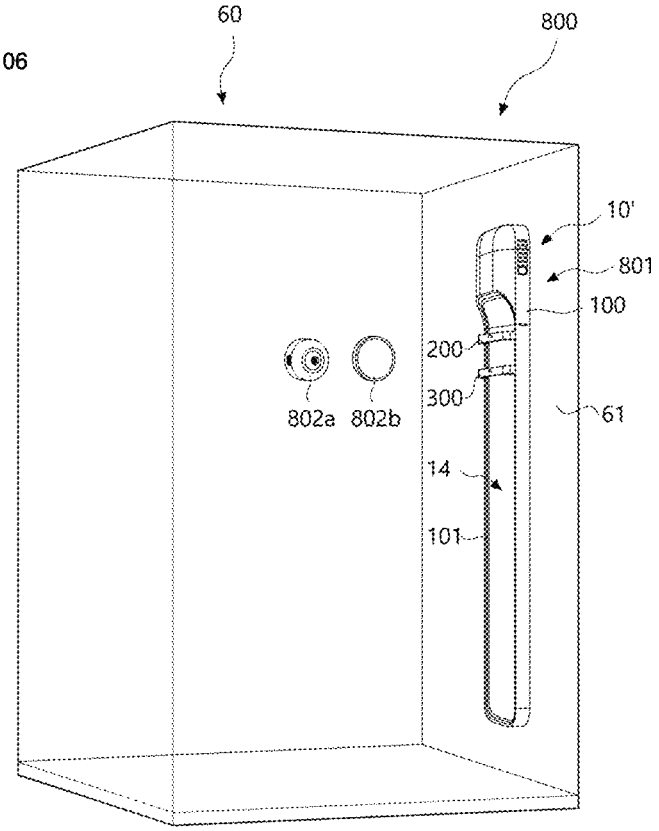
FIG. 6 is a perspective view of a drying arrangement according to another embodiment.

A drying arrangement 800 configured according to an alternative embodiment is illustrated in FIG. 6. The drying arrangement 800 illustrated therein is similar in configuration to the previously described drying arrangements, except that the primary drying module comprises a drying apparatus 10' that includes not only a bar 200, but further includes a second bar 300, as described in connection with FIG. 3. The second bar 300 can optionally be movable relative to the body 100 of the drying apparatus 10'. Further, the second bar 300 can be configured to have the same features and functionality as bar 200. Alternatively, the second bar 300 can have a different configuration and or functionality when compared with bar 200.

Thus, for example, the primary drying module 801 can comprise drying apparatus 10, as illustrated in FIG. 4. Alternatively, the primary drying module 801 can comprise the drying apparatus 10', as illustrated in FIG. 6. The features and functionality of the drying apparatus 10 and 10' will be described in greater detail below.

Figure 7A:
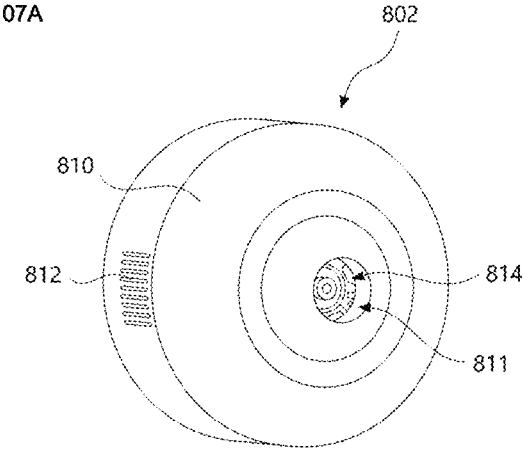
FIG. 7A is a perspective view of an embodiment of a secondary drying module.
Figure 7B:
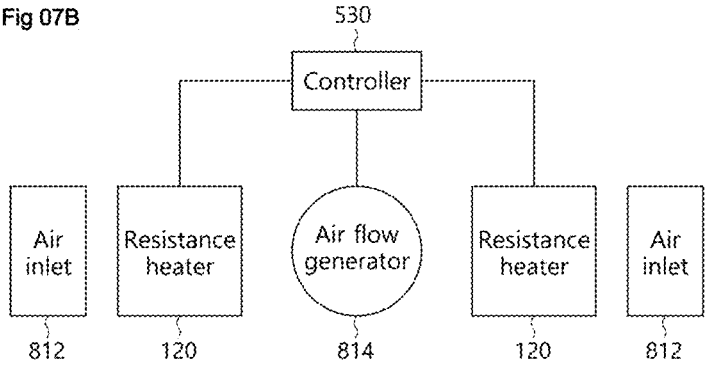
FIG. 7B is a block diagram of the secondary drying module of FIG. 7A.

The construction of the secondary drying module 802 (e.g., 802*a*, 802*b*), according to certain embodiments, are illustrated in FIGS. 7A and 7B. According to the illustrated embodiment, the secondary drying module 802 comprises a housing 810 formed from any suitable material, such as plastic. The housing 810 may include an air outlet 811 and an air inlet 812. The secondary drying modules 802 may optionally include an air flow generator 814 for providing a flow of air from the inlet 812 to the outlet 811. The air flow generator 814 can be constructed according to the same principles, and with the same features and functionality as the air flow generator associated with drying apparatus 10 or 10', which will be described in greater detail below. For example, the air flow generator 814 may be constructed same as or similar to the air flow generator 110 of the body 100 (see FIGS. 16A and 16B) or the flow generator 204 of the bar 200 (see FIG. 26).

The secondary drying module 802 may further optionally include a resistance heater 120 located downstream of the air inlet 812 and upstream of the flow generator 814. When operational, the resistance heater 120 may heat the intake air of the air inlet 812 prior to being sucked into the air flow generator 814. The present embodiment contemplates having two air inlets 812 with each air inlet 812 associated with a resistance heater 120. However, other configurations may have one air inlet or more than two air inlets. Also, the other configurations may have one resistance heater or more than two resistance heaters. Also, instead of a resistance heater, a thermoelectric device (to be described below) may be used. A thermoelectric device may be beneficial in that a thermoelectric device is able to heat the intake air or cool the intake air, and thereby providing for the secondary drying module 802 to expel hot air or cold air, respectively.

According to one embodiment, the air outlet 811 is fixed relative to the housing 810. According to an alternative embodiment, the air outlet 811 is movable relative to the housing 810. For example, the air outlet 811 can be in the form of a movable nozzle, similar in construction to the nozzle of an aircraft ventilation system located above an airline seat, but movable using a motor. The motor may be controlled by a controller 530. This configuration is desirable where the forced airflow may be directed, from a top position to a bottom position thereby drying a user from the top to the bottom. Alternative constructions for repositioning the air outlet 811 and thus redirecting the flow of air therefrom are contemplated and encompassed by the present invention.

A distributed drying arrangement 800 may also include the controller 530. The controller 530 may be a microprocessor, an integrated circuit, an electrical circuit, a logical electrical circuit, and the like. The controller 530 may control the operation of the secondary drying module 802. For example, the controller 530 may control the operation of the air flow generator 814; may control the operation of the resistance heaters 120 or thermoelectric devices if the thermoelectric devices are used; and may control the direction of the nozzle if the nozzle is movable. The controller 530 may operate autonomously. For example, the controller 530 may detect the wetness of the user using a thermal sensor (to be described in detail further below) located at the secondary drying module 802 or in the distributed drying arrangement 800 and control the movable nozzle up/down to dry the user.

Figure 29:
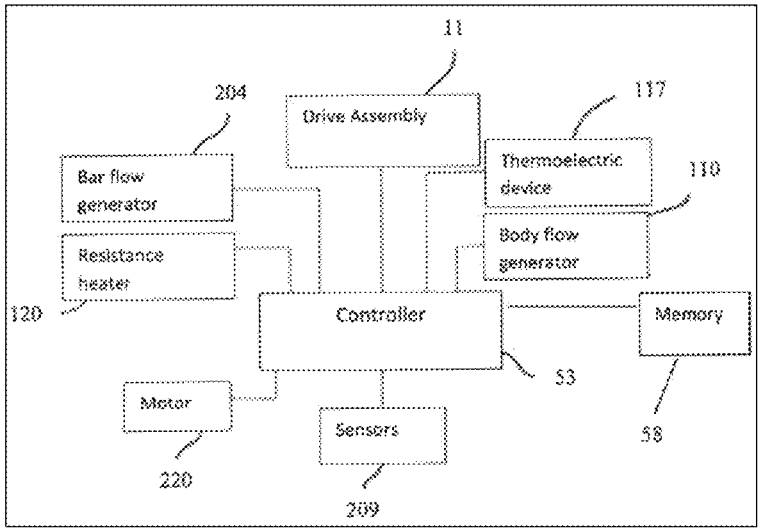
FIG. 29 is an electrical schematic diagram of the drying apparatus according to an embodiment of the present invention.

In another configuration, the controller 530 may receive and operate under the control of a controller 53 (see FIG. 29). The control signals may be received by wire or wirelessly. The controller 53, located at the primary drying module 801, can control the operation of the primary drying module 801, and optionally any secondary drying modules 802. In this configuration, the controller 53 instructs the controller 530 on the operation of the secondary drying module 802. For example, the controller 53 may instruct the controller 530 to move the nozzle of the secondary drying module 802 such that it mimics the up/down movement of the bar 200 of the primary drying module 801. In another example, the controller 53 may instruct the controller 530 to move the nozzle such that the nozzle is directed to the hair of the user. Thereby, while the secondary drying module 802 is drying the hair, the primary drying module 801 may dry the body of the user. Many configurations of the operations of the secondary drying module 802 in cooperation with the operations of the primary drying module 801 may be contemplated and encompassed by the present invention.

Alternatively, each controller 530 of the secondary drying module 802 works in conjunction with one another to provide the desired drying effect. The one or more controllers 530 can receive signals from one or more sensors disposed on the secondary drying module or modules 802, or within the distributed drying arrangement 800, such as a thermal sensor, humidity sensor, proximity sensor, infrared sensor, etc. The signals received from such sensors can be used by the controller to affect operation of the distributed drying arrangement 800. For example, if it is determined that one lateral portion of the user is suitably dried based on output from a sensor, the controller 530 can decrease or cease the operation of the flow generator associated with directing airflow to that portion of a user's body. Additionally, airflow can be reoriented and directed to areas of the user's body which is not yet suitably dry. Additional details regarding the control structure and operation will be described in greater detail below.

Figure 8:
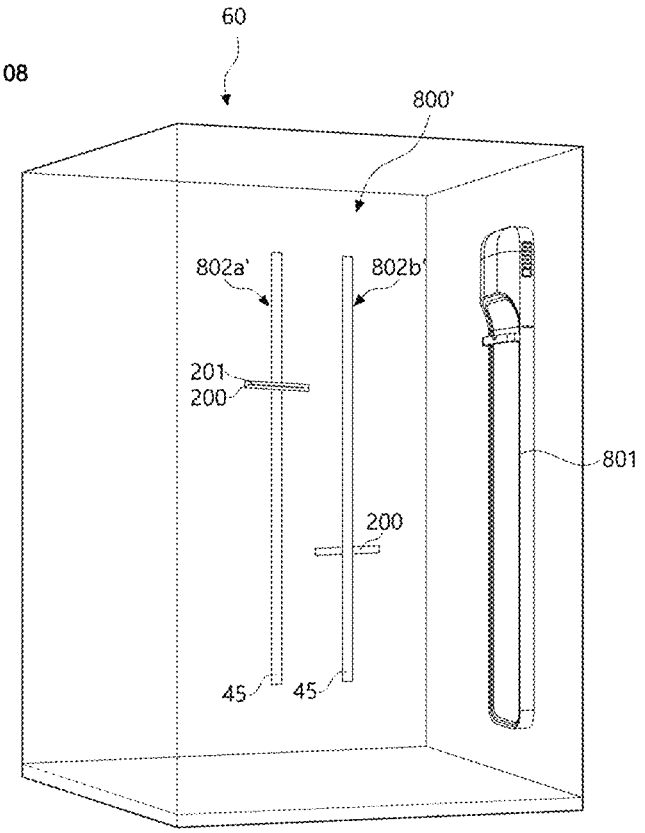
FIG. 8 is a perspective view of another embodiment of a drying arrangement.

A distributed drying arrangement 800' constructed according to a further embodiment is illustrated in FIG. 8. The distributed drying arrangement 800' is similar to the arrangement 800 of FIG. 4, and can possess the same general features and functionality previously described herein. The main difference being that one or more of the secondary drying modules 802 are provided with at least one longitudinally movable bar 200 with a respective air outlet 201. For example, the moving bar 200 may be in the configurations illustrated in FIGS. 22-28. According to the illustrated embodiment, two opposing secondary drying modules 802*a*', 802*b*' each have a movable bar 200 with a respective air outlet 201. The movable bar 200 is movable in the longitudinal direction of the secondary drying modules 802. The movable bar 200 can have the same features and functionality as the movable bar 200 associated with the primary drying module 801, and further described herein. This can be provided by moving the bar 200 with a guide member or members 45. This movement can be manual, driven, or combination of both. Particular mechanisms for driving the movable bars of both the primary drying module and the secondary drying modules will be described in greater detail below. According to further alternative embodiments, one or more of the secondary drying modules 802 can include a plurality of movable bars 200, such as the drying apparatus 10' of FIG. 3, according to one nonlimiting example.

The construction, features and functionality of the drying apparatus 10, 10' associated with the primary drying module 801 of the distributed drying arrangement 800 will now be described in detail. It should be understood that while the discussion is centered around the drying apparatus 10, the principles, features and functionality described herein are equally applicable to the construction and functionality of the alternative drying apparatus 10'. Similarly, it is to be understood that the following description of the features, functionality and control of the movable bars 200 is equally applicable to movable bars associated with a primary drying module 801, as well as a secondary drying module 802 that incorporates such movable bars. It is to be understood that the following description of the features and functionality of the various driving apparatus applies to movable bars of both the primary and secondary drying modules.

Figure 9:
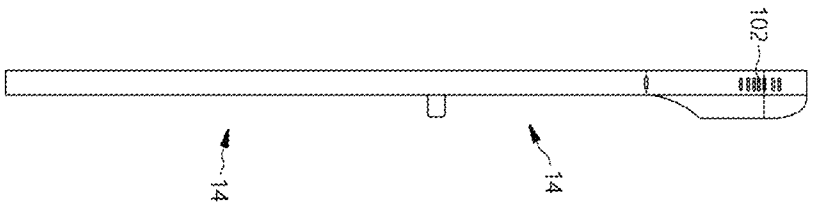
FIG. 9 is a side view of the drying apparatus according to the embodiment of FIG. 1.

When the drying apparatus 10 is to be provided within a confined space, such as a bathroom, it may be desirable that a minimum of space is taken up by the drying apparatus 10, and perhaps, be aesthetically pleasing. To this end, the portion including the drying face 14 of the body 100 may be provided having a low profile, such as is seen in FIG. 9, a side view of FIG. 10. This low profile may provide for a slim look.

To achieve this low profile, at least some internal components of the body 100 which are bulky may be distributed toward an upper region of the body 100 (in the vicinity of the air inlets 102 shown in FIG. 9), so as not to interfere with the low profile of the portion having the drying face 14. The upper region of the body 100 may be at or above the head of a user. The upper region may include the bulky components such as flow generators, thermoelectric devices, flow guides, and the like. In an alternative embodiment, the internal components of the body 100 may be distributed toward a lower region of the body 100 (not shown) providing for an upper region of the body to have a minimized depth.

Figure 11:
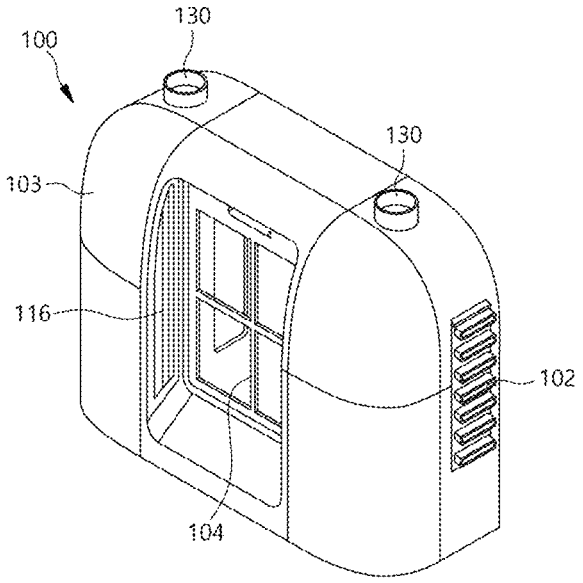
FIG. 11 is a view of an upper region of the drying apparatus according to the embodiment of FIG. 1.
Figure 12:
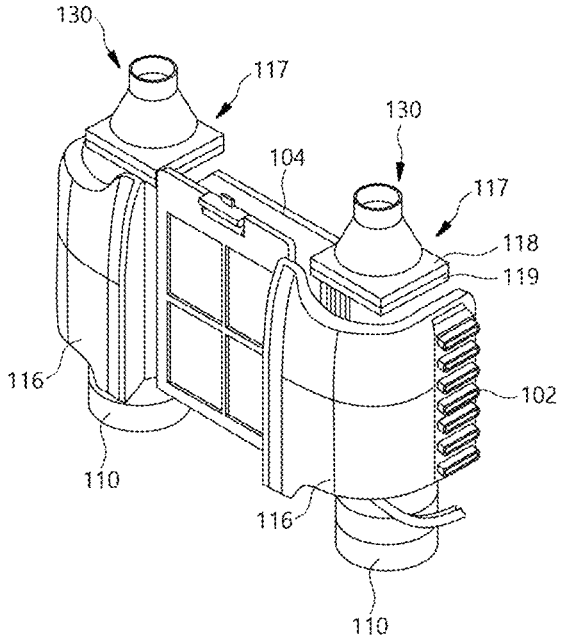
FIG. 12 is a perspective view showing some internal components of the upper region of FIG. 11.

FIG. 11 is a view of details of an example upper region of the body 100. In particular, in FIG. 11 a front cover of the upper region has been removed to expose an outlet of one of two flow guides 116, adjacent to a filter unit 104. The other air flow guide 116 is not visible in FIG. 11, but may be provided on the other side of FIG. 11. The filter unit 104 is in opposition to and/or cooperation with flow guide 116 and arranged in a recess at the center of the body 100. The filter unit 104 may or may not be replaceable. Front cover (not shown in FIG. 11) may be removed to replace an old filter unit 104 with a new filter unit. FIG. 12 shows the coverings of the upper region removed to expose some internal components of the upper region of the body 100 shown in FIG. 11.

Referring to FIGS. 11 and 12, together, the upper region of the body 100 may include a pair of flow generators 110, a pair of flow guides 116, a pair of thermoelectric devices 117 (this device includes, for example, a thermoelectric module, a thermoelectric cooler, or other suitable devices), a pair of air inlets 102, the filter unit 104, and the flow generator housing 103 to house the internal components. While one embodiment uses thermoelectric devices 117 which are devices using thermoelectric effect such as Peltier effect, alternative embodiments may include air conditioning or heat-pump systems using a pump, compressors, and evaporators, resistive heating elements, combustion, or other chemical reaction to control temperature. However, other types of air conditioning devices may be used. In one aspect, the upper region may be considered as an air conditioning system of the body 100.

In the illustrated embodiment, a pair of flow generators 110 are used. In alternative embodiments, only a single flow generator, or a greater number of flow generators, may be used. A flow generator may be an axial fan or the like. Embodiments that include multiple flow generators may cooperate to produce an even airflow into the body 100. Embodiments also include generating independent airflows into the body 100 to vary the strength of the airflow at various portions of the body 100. In the present embodiment, outside air may be received into the flow generator housing 103, by operation of the pair of flow generators 110, through a pair of air inlets 102. The pair of air inlets 102 provide inlet points for outside air into the body 100.

As seen in FIG. 12, each flow generator 110 has its own respective air inlet 102. However, a single inlet 102 may be used with the pair of flow generators 110. Alternatively, more than two air inlets may be used with the pair of flow generators.

Air received at the air inlets 102 is ducted by respective flow guides 116 located between the air inlets 102 and the filter unit 104. In the present embodiment, each flow guide 116 may also in part define an outlet air flow pathway 105 (see FIG. 14) which may be a portion of a flow path where filtered air from the filter unit 104 flows to a respective flow generator 110. Further details of the flow path including the outlet air flow pathway 105 will be described in connection with the description of FIGS. 13 and 14.

Because the present embodiment is described as comprising a pair of flow guides 116, it will be understood that the following description of one flow guide 116 also reflects the other flow guide of the flow guide pair 116. To this end, each flow guide 116 may have a curved form as seen in FIG. 12. One end of each flow guide 116 is connected to a respective air inlet 102, and the other end opens to the upstream side of the filter unit 104. The body of each flow guide 116 includes a curved inner surface and a curved outer surface. The curved inner surface faces the outlet air flow pathway 105 and forms part of the flow path between the downstream side of the filter unit 104 and a respective flow generator 110.

Thus, each flow guide 116 forms a flow path between a respective air inlet 102 and the upstream side of the filter unit 104. Also each flow guide 116 forms, at least in part, a wall of the flow path between the downstream side of the filter unit 104 and a respective flow generator 110. In this configuration, each flow guide 116 may duct air received from a respective air inlet 102 and pass the air to the filter unit 104. Air passed through the filter unit 104 may flow to the outlet air flow pathway 105 where a flow generator 110 may force the air to the first air outlet 101.

In the configuration above, each flow guide 116 may function to separate between the inlet side and outlet side of the filter unit 104. Each flow guide 116 may also function to separate the air received from the air inlet 102 from the filtered air flowing towards the flow generator 110.

In an alternative configuration, the flow guide 116 may not have a dual function of guiding inlet air to the filter unit and guiding filtered air between the filter unit outlet and the flow generator. For example, the air inlets 102, the flow guides 116, the filter unit 104, and the flow generators 110 may be arranged to be linear or sequentially adjacent to each other. Here, each flow guide 116 only ducts the air between the air inlet 102 and the filter unit 104.

The principles, features, and construction associated with the air flow generators 110 can be used to provide similarly constructed and functioning air flow generators 814 associated with the secondary drying modules 802 described above.

A pair of thermoelectric devices 117 may also be included in the upper region of the body 100. Each thermoelectric device 117 may be a semiconductor device that heats and/or cools air, for example, using the Peltier effect. In alternative embodiments, other types of known thermal elements may be employed, such as, a heater, a cooler, or a combination thereof. For example, a refrigeration cycle, having a compressor, evaporator, and condenser, may be utilized to provide cooling and/or heating of air. In another example, a resistance heater may be utilized to provide heating of the air.

In the present embodiment, there is a pair of thermoelectric devices 117. Thus, in the following description of one of the thermoelectric device 117, it will be understood that other thermoelectric device is the same. To this end, each thermoelectric device 117 has a first side 118 and a second side 119. Depending on the direction of current supplied to the thermoelectric device 117, one side may be cooled or heated while the other side is respectively heated or cooled. For example, when the first side (i.e., outward) 118 is cooled, the second side (i.e., inward) 119 is heated. Conversely, when the first side 118 is heated, the second side 119 is cooled.

Each thermoelectric device 117 may heat or cool the air in the outlet air flow pathway 105 (see FIG. 14) that has passed through the filter unit 104. To facilitate this, the second side 119 of the thermoelectric device 117 may be exposed to the outlet air flow pathway 105. Depending on the operation mode of the thermoelectric device 117, the second side 119 may heat or cool the air passing through the outlet air flow pathway 105. The heated or cooled air may then be sucked into a respective flow generator 110.

A processor may control the direction of the current flowing through thermoelectric device 117. For example, a voltage source coupled to the thermoelectric device 117 may be coupled to an analog-to-digital converter (A/D). The A/D converter may be able to generate positive or negative values to control the voltage and therefore the current applied to the thermoelectric device 117. In other embodiments, the A/D converter could have half of its output values corresponding to negative current and half corresponding to positive current.

An exhaust vent 130 may be provided at the upper region of the body 100 when a thermoelectric device 117 is used in the drying apparatus. FIG. 12 shows a pair of exhaust vents 130 associated with the pair of thermoelectric devices 117 that are included in the upper region of the body 100, as illustrated in FIG. 12. Each exhaust vent 130 may be coupled to the first side 118 of a respective one of the thermoelectric devices 117. One or more exhaust vents 130 may be provided at the upper region of the body.

When the thermoelectric device 117 operates as a heater, the cool exhaust air may be vented by a respective exhaust vent 130 to the outside of the drying apparatus 10. When the thermoelectric devices 117 operates as a cooler, the hot exhaust air may be vented by the exhaust vents 130.

The principles, features, and construction associated with the thermoelectric device 117 can be used to provide the secondary drying modules 802 with similarly constructed and functioning thermoelectric devices.

Figure 13:
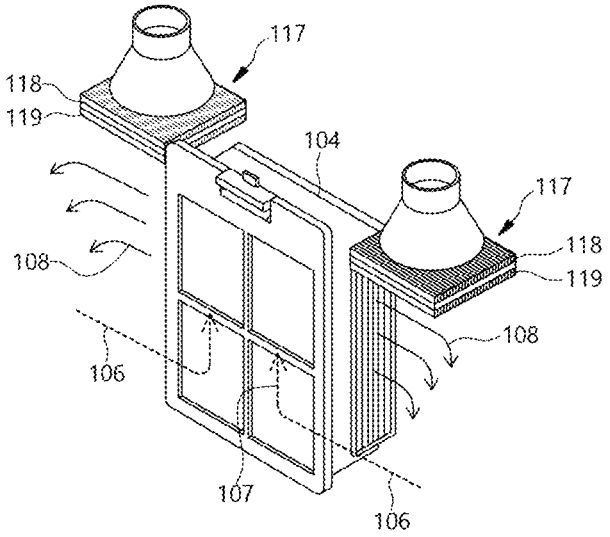
FIG. 13 is a perspective view of an air flow through the internal components of the upper region of FIG. 12.
Figure 14:
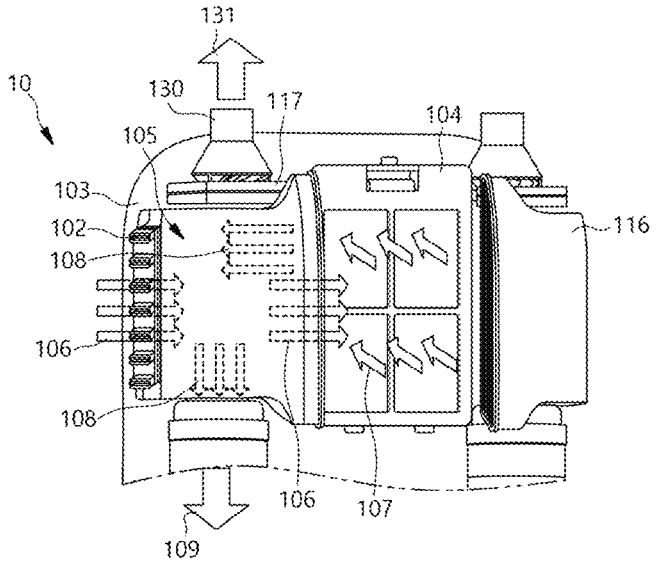
FIG. 14 is another view of the air flow through the internal components of the upper region according to a further embodiment.

FIG. 13 is an illustration of air flow through the parts of the upper region of the body 100 according to the embodiment of the present invention. FIG. 14 is another illustration of the air flow through the parts of the upper region of the body 100. The air flow through the components of the upper region of the body 100 will be described with respect to one flow generator 110 as the air flow will be similar for the other flow generator 110.

The present embodiment will now be described in greater detail with reference to FIGS. 13 and 14. When the flow generator 110 operates, air is received through the air inlet 102 and through the flow guide 116 thereby arriving at the front surface of the filter unit 104 as illustrated by air flow arrows 106 and 107 in FIG. 14. The air then passes through the front surface of the filter unit 104. The filtered air exits through the sides of the filter unit 104.

The filtered air, after exiting filter unit 104, arrives at the outlet air flow pathway 105 illustrated by air flow arrows 108 in FIG. 14. The filtered air in the outlet air flow pathway 105 may be heated or cooled by the thermoelectric device 117. The exhaust air from the thermoelectric device 117 may then be vented by the exhaust vent 130 as described above, and as illustrated by air flow arrow 131. The heated or cooled air illustrated by air flow arrow 108 is sucked down into and through the flow generator 110, and then forced, by the flow generator 110, onwards to the first air outlet 101, as illustrated by air flow arrow 109 in FIG. 14.

A configuration of an air conditioning system of the body 100 has been described above. The drying apparatus 10 having the configuration above may vent cool air or hot air to condition a space in which the drying apparatus is occupying. The space may be a bathroom. During hot days the drying apparatus 10 may cool the bathroom. During cold days the drying apparatus 10 may heat the bathroom. The drying apparatus may also use the air conditioning system described herein to dry a user. For example, the cool air or hot air forced by the flow generator 110 is vented by the first air outlet 101 along the periphery of the body 100 at the drying face 14 (see FIG. 10). A user presenting themselves at the drying face 14 may dry themselves through the vented cool air or hot air.

Figure 15:
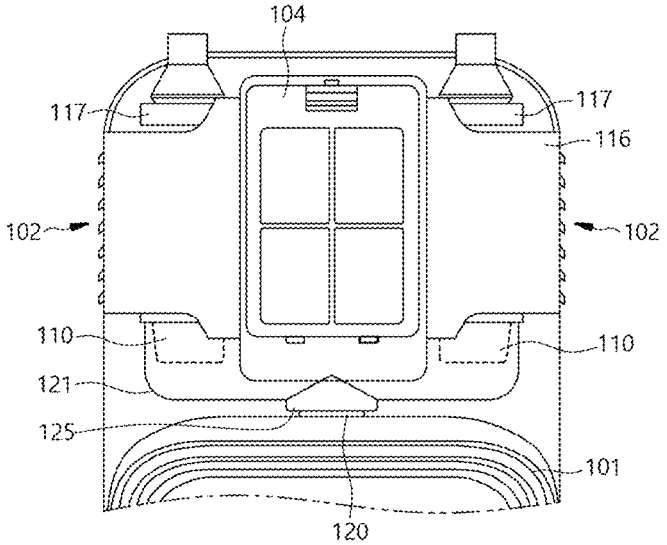
FIG. 15 is a view showing a connection between flow generators and a first air outlet according to an embodiment of the present invention.

FIG. 15 is a view illustrating a connection between the flow generators 110 and the first air outlet 101 of the body 100, according to an embodiment of the present invention.

As shown, the flow generators 110 force the airflow into a duct 121. At the duct 121, the forced airflows from the two flow generators 110 are combined into a single forced airflow. The duct 121 then guides the combined forced airflow through a common opening 125 into the first air outlet 101 of the body 100. In the present embodiment, a resistance heater 120 is disposed at the common opening 125 to further heat the forced airflow. This configuration may be used where it is desirable that a heated forced airflow from the flow generators 110 is further heated prior to being expelled into the first air outlet 101. This configuration may be used, for example, where a quick heating of a bathroom is desired or a more heated forced airflow is desired during a drying of the user.

While in FIG. 15, a resistance heater has been illustrated, any other suitable thermal elements may be used. In other configurations the thermal element may be a thermoelectric device that may be used to selectively heat or cool the forced airflow flowing out of the common opening 125.

Figure 16A:
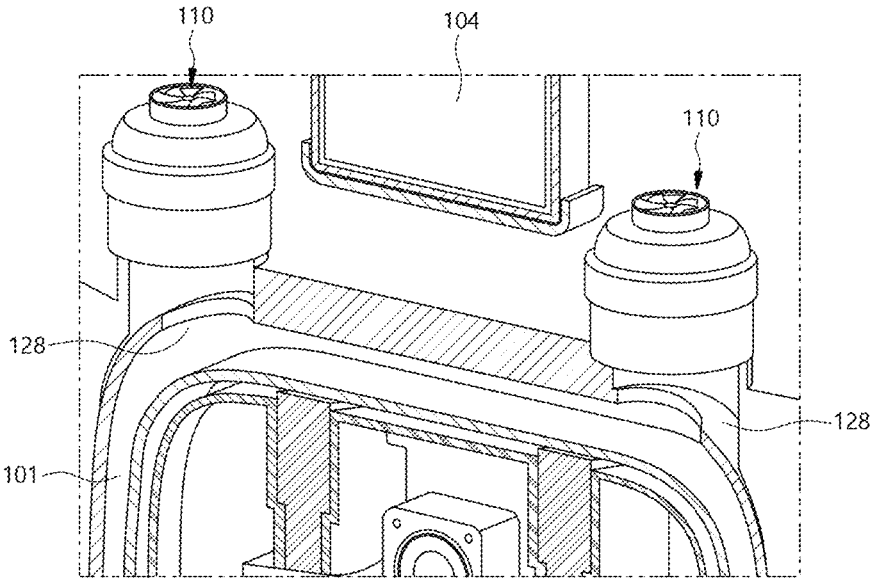
FIG. 16A is a view showing a connection between the flow generators and the first air outlet according to another embodiment of the present invention.

FIG. 16A illustrates a connection between the flow generators 110 and the first air outlet 101 of the body 100 according to an alternative embodiment of the present invention. Unlike the embodiment illustrated in FIG. 15, the outlet of each of the flow generators 110 directly connects to the first air outlet 101 of the body 100 according to the alternative embodiment of FIG. 16A. The first air outlet 101 thus includes air openings 128 at the upper side of the first air outlet 101. Each air opening 128 communicates directly with the outlet of respective one of the flow generators 110. By having the outlet of each flow generator 110 directly connect to the first air outlet 101 of the body 100, the connection structure may be simplified and the forced airflow may be directly expelled into the first air outlet 101.

The forced airflow in the present embodiment may be stronger than the forced airflow of the embodiment of FIG. 15. The reason is that, in the forced airflow of FIG. 15, the vertical direction of the forced airflows of the respective flow generators are forced into a horizontal direction by the duct 121, then made to collide with each other to form a single forced airflow. The duct 121 then forces the single combined forced airflow to flow vertically downward into the first air outlet 101. In contrast, in the embodiment of FIG. 16A, the forced airflows of the respective flow generators flow vertically downward directly into the first air outlet 101.

Figure 16B:
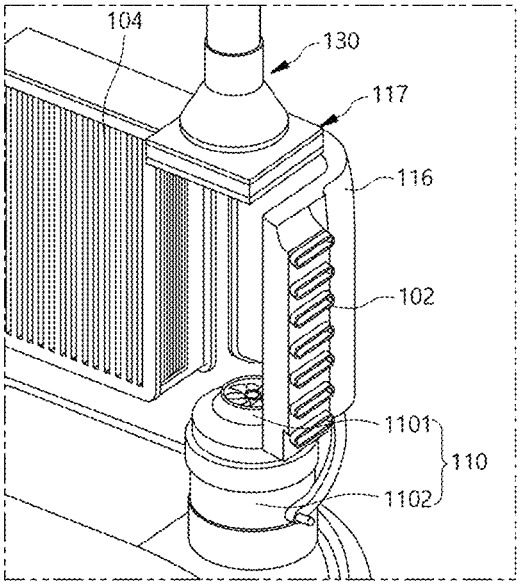
FIG. 16B is a rear perspective view showing a connection between one of the flow generators and the first air outlet of FIG. 9A.

FIG. 16B is a rear perspective view showing a connection between one of the flow generators and the first air outlet of FIG. 16A. As shown in FIG. 16B, in this configuration, the flow generator 110 includes a fan assembly 1101 and a conduit 1102. The fan assembly may be an axial fan and the like. Preferably, the fan assembly includes a high speed motor that sucks in air and expels air at high speed. For example, the fan assembly may be Smart Inverter Motor™ available from LG Electronics, Inc., Republic of Korea, that operates at speeds up to 115,000 revolutions per minute (RPM). Similar fan assembly may be used.

The fan assembly 1101 is connected to the conduit 1102 which may be a cylindrical tube that connects to the first air outlet 101. However, it should be appreciated that the conduit 1102 is not limited to a cylindrical tube and other configurations may be used such as an oval tube, a square tube, a rectangular tube, etc. The conduit 1102 contains the air sucked in by the fan assembly 1101 within the confines of the conduit 1102 thereby increasing the speed of the forced airflow if not maintaining the speed of the forced airflow expelled by the fan assembly 1101. Thus, a forced airflow of relatively high speed is introduced into the first air outlet 101.

Figure 10:
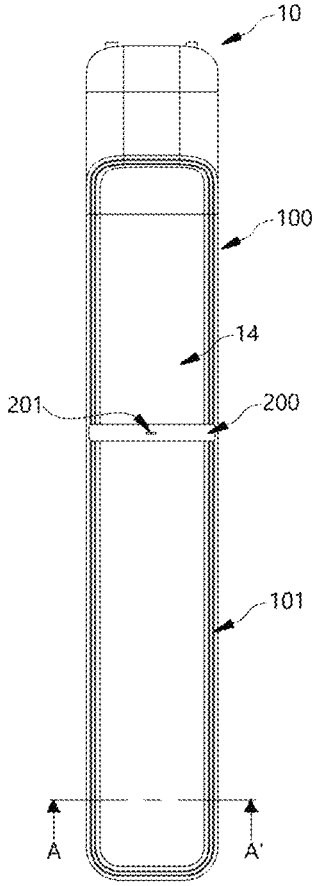
FIG. 10 is a front view of the drying apparatus according to the embodiment of FIG. 1.
Figure 17:
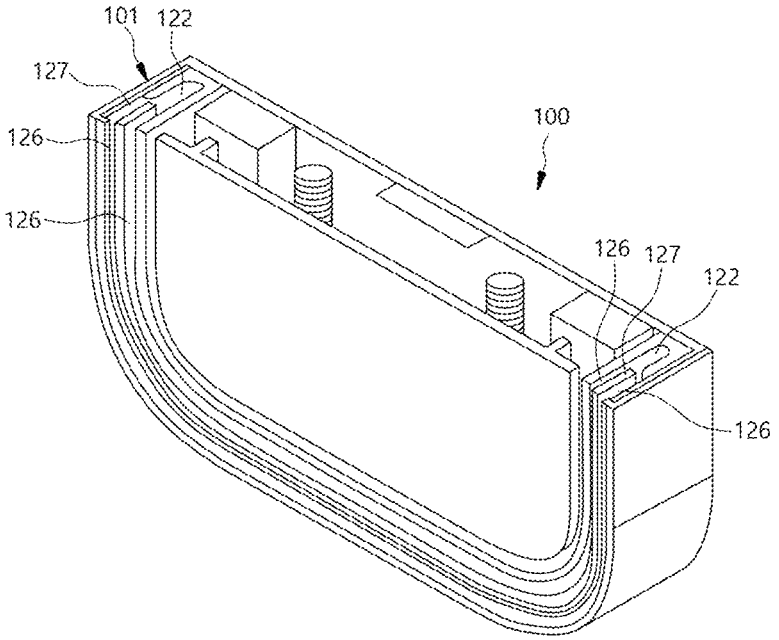
FIG. 17 is a cross-sectional view of the first air outlet along line A-A' of FIG. 10.

FIG. 17 is a cross-sectional view along line A-A' of FIG. 10 further illustrating the first air outlet 101 of the body according to an embodiment of the present invention. As shown in part, the first air outlet 101 is distributed around at least a partial periphery of the body 100. In the present embodiment, the first air outlet 101 actually follows the contour of the periphery of the drying face 14 of the body 100 (see FIG. 10). However, one skilled in the art will readily appreciate that the air outlet 101 could take on any one of a number of other configurations. For example, in an alternative embodiment, the first air outlet 101 may be configured as a plurality of slits placed vertically and/or horizontally across the drying face 14 (see, for example, FIG. 39).

Again, referring to FIG. 17, the first air outlet 101 according to the present embodiment, includes a duct 122, a vent 126, and a fin 127. The duct 122 receives the forced airflow from the upper region of the body 100, and ducts the forced airflow along the periphery of the body 100.

The duct 122 is connected to the vent 126 which also runs along the periphery of the body 100 and is visible from the drying face 14 of the body 100 (see FIG. 10). The forced airflow exits the body 100 through the vent 126. The fin 127 may be disposed in the vent 126 which also runs along the periphery of the body 100 and divides the space formed by the vent 126 into two. The fin 127 may aid in directing the forced airflow flowing out from the vent 126. In the present embodiment, the fin 127 is fixed in the vent 126 and directs the forced airflow in one direction which is straight outwardly.

In an alternative configuration, the fin may be adjustable to be moved to the left or to the right to direct the forced airflow exiting the body 100 in the left direction or the right direction, as desired. For example, the fin of the left side of the body 100 may be moved in the right direction and the fin on the right side of the body 100 may be moved in the left direction so that at least a portion of the forced airflow may converge inwardly towards a center with respect to the body 100. Conversely, the fin of the left side of the body 100 may be moved in the left direction and the fin on the right side of the body 100 may be moved in the right direction so that at least a portion of the forced airflow may diverge outwardly away from the center with respect to the body 100.

Thus far, the body 100 of the drying apparatus 10 according to embodiments of the present invention has been described. The drying apparatus 10 may include a bar 200 that may expel forced airflow. The bar 200 may be movable relative to the body 100, as previously mentioned.

Figure 18A:
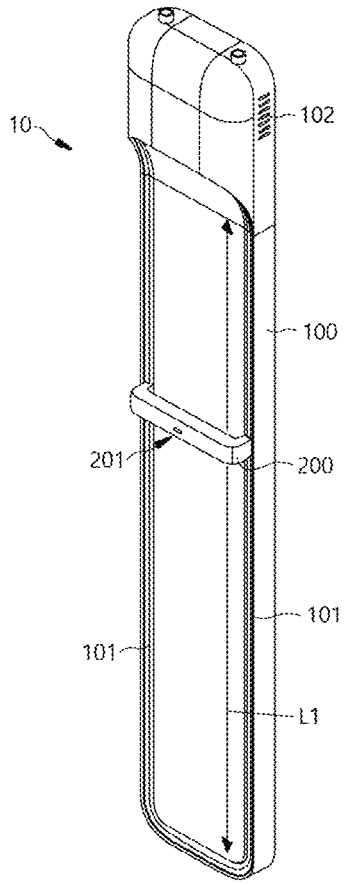
FIG. 18A is a perspective view of the drying apparatus of FIG. 1 with a bar thereof in a first position.
Figure 18B:
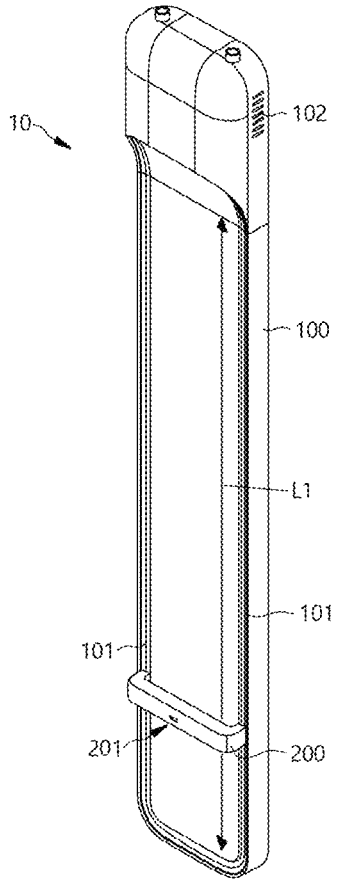
FIG. 18B is a perspective view of the drying apparatus of FIG. 1 with the bar thereof in a second position.

FIGS. 18A and 18B are views illustrating a bar 200 at two respective driven positions along the longitudinal length L1 of the body 100 according to the present embodiment of the present invention.

The bar 200 may be moveable along the longitudinal length L1 of the body 100 driven by a drive apparatus to be described later. The travel bounds of the bar 200 may be fixed to coincide with longitudinal length L1, of the body 100 or, alternatively, it could be adjustable to more closely coincide with the height by a particular user. Accordingly, the drying apparatus 10 may be configured such that when the user is positioned adjacent to the drying face 14, the desired length (e.g., the height) of the user may be covered by the drying airflow of the second air outlet 201 by the movement of the bar 200. For example, the bar 200 may move from the top position as shown in FIG. 18A to the bottom position as shown in FIG. 18B (and back in repetition if desired) while expelling forced airflow from the second air outlet 201, where the distance traveled between the position of the bar 200 in FIG. 18A and in FIG. 18B may correspond with the height of the user.

Figure 19A:
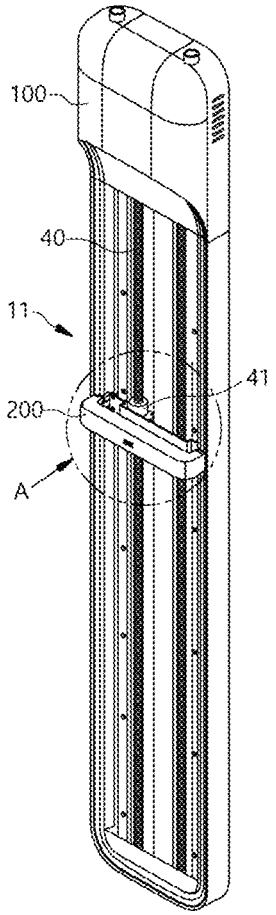
FIG. 19A is a perspective view showing a driving apparatus for a drying apparatus according to an embodiment of the present invention.
Figure 19B:
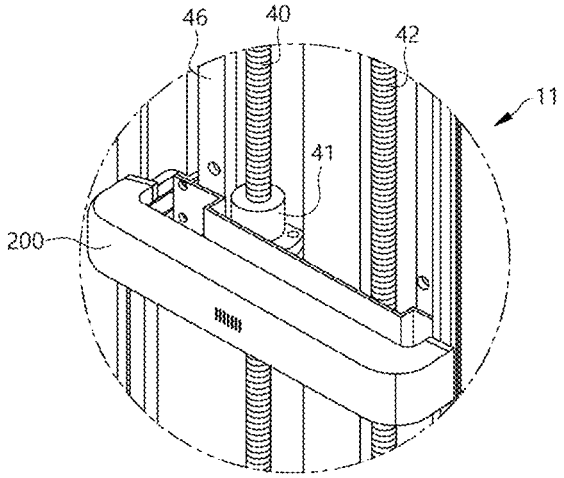
FIG. 19B is a close up view of the portion A of FIG. 19A.
Figure 19C:
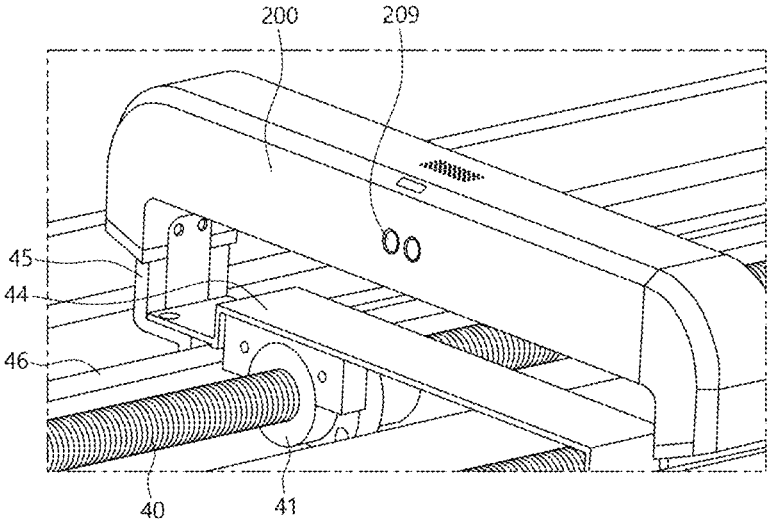
FIG. 19C is bottom view of FIG. 19B.
Figure 19D:
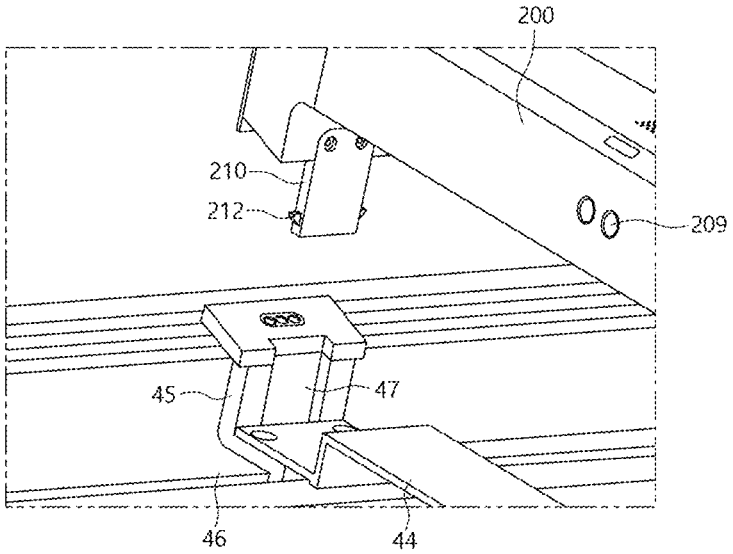
FIG. 19D is a view showing a fastening mechanism of a bar of a drying apparatus according to an embodiment of the present invention.

FIG. 19A is a view illustrating a driving apparatus of the bar 200 according to the present embodiment of the present invention. FIG. 19B is a close up view of the drive apparatus illustrated in portion A of FIG. 19A. FIG. 19C is bottom view of the drive apparatus illustrated in FIG. 19B, and FIG. 19D is a view illustrating an exemplary fastening mechanism 210 of the bar 200 according to an embodiment of the present invention.

Referring to FIGS. 19A and 19B, the drive apparatus 11 drives the bar 200 relative to the body 100. The drive apparatus 11 may be provided at the body 100. In accordance with this exemplary embodiment, the drive apparatus 11 includes a lead screw 40, a nut 41, and a motor 50 (see FIG. 20). The lead screw 40 is threaded and may have a length corresponding to the longitudinal length L1 of the drying face 14 of the body 100. The motor 50 may be located at the upper region of the body 100. However, the motor 50 may be located anywhere as long as the motor 50 is able to rotate the lead screw 40 thus causing the nut 41 to move up or down the lead screw 40, depending on the direction of rotation of the lead screw 40, along the longitudinal length L1 of the drying face 14 of the body 100. A shaft of the motor 50 may be coupled to one end of the lead screw 40 (e.g., the upper end of the lead screw 40). Therefore, when the motor 50 rotates the shaft clockwise, the lead screw 40 rotates clockwise. When the motor 50 rotates the shaft counterclockwise the lead screw 40 rotates counterclockwise.

Referring to FIGS. 19B and 19C, the nut 41 is threaded corresponding to the thread of the lead screw 40 and is thus mated with the lead screw 40. The nut 41 is fixed to the bar 200. In the present embodiment, the nut 41 is fixed to a bracket assembly 44 to which the bar 200 is attached. However, one skilled in the art will appreciate that other configurations for fixing the nut 41 to the bar 200, direct or indirect, are possible. When the lead screw 40 is rotated by the motor 50, the nut 41 rides up or down on the lead screw 40 which, in turn, moves the bar 200 up or down.

For example, when the motor 50 rotates the lead screw 40 clockwise, the nut 41 moves up the lead screw 40, which in turn moves the bar 200 up with respect to and along the longitudinal length of the body 100. On the other hand, when the motor 50 rotates the lead screw 40 counterclockwise, the nut 41 moves down the lead screw 40, which in turn moves the bar 200 down with respect to and along the longitudinal length of the bar 200.

In another example, when the motor 50 rotates the lead screw 40 clockwise, the nut 41 moves down the lead screw 40, which in turn moves the bar 200 down with respect to and along the longitudinal length of the body 100. When the motor rotates the lead screw 40 counterclockwise, the nut 41 moves up the lead screw 40, which in turn moves the bar 200 up with respect to and along the longitudinal length of the bar 200.

Figure 20:
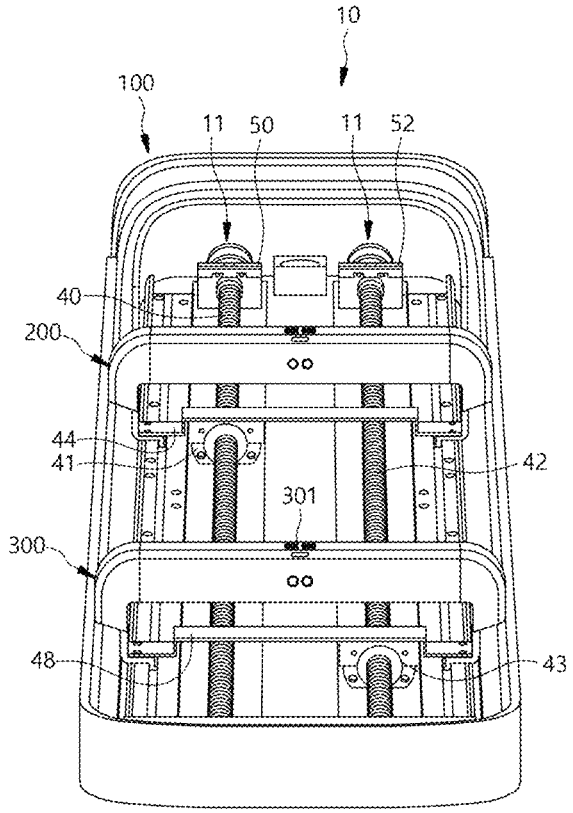
FIG. 20 is a perspective view showing a drying apparatus including additional bars according to an embodiment of the present invention.

Referring to FIGS. 19C and 19D, the bracket assembly 44 may have one or more guide members 45 for running in one or more corresponding guide tracks 46 of the body 100. In the present embodiment, as illustrated in FIG. 20, a dual guide track is used, including a guide track 46 which runs vertically on both sides of the body 100. Together, the guide members 45 and guide tracks 46 guide the bar 200 along a predetermined vertical path.

For example, the guide members 45 and guide tracks 46 may operate to retain the bar 200 against rotational movement about the longitudinal axis which may be caused due to the rotation of the lead screw 40. The dual guide tracks 46 may also provide stability to the bar 200 as it moves up and down along the body 100.

In the present embodiment, the bar 200 may include a fastening mechanism 210 to fasten to the guide member 45 of the bracket assembly 44. A fastening mechanism 210 is provided at both ends of the bar 200 in the present embodiment. The guide member 45 may include a recess 47 having a shape corresponding to the shape of the fastening mechanism 210. When the bar 200 is attached to the bracket assembly 44, the fastening mechanism 210 slides into the recess 47 of the guide member 45, thus attaching the fastening mechanism 210 to the guide member 45.

The fastening mechanism 210 may include one or more protrusions 212 that protrude from the sides of the fastening mechanism 210. The one or more protrusions 212 may be elastically deformable or may be spring loaded. When the fastening mechanism 210 has been fully inserted into the recess 47 of the guide member 45, the one or more protrusions 212 may hook into one or more corresponding slots in the recess 47 to attach the bar 200 to the bracket assembly 44.

The fastening mechanism 210 may provide for easy detachment of the bar 200 from the bracket assembly 44. Because the protrusions 212 are elastically deformable or spring loaded, the bar 200 may be detachable from the body 100 by exerting sufficient force. The bar 200 may be replaced with another bar 200 or may be serviced without the need for taking the entire drying apparatus 10 for servicing.

An embodiment of a drive apparatus using a lead screw and nut has been described. In other exemplary configurations, the bar 200 may be driven upon the body 100 by components other than a lead screw and nut. In fact, any suitable drive apparatus capable of providing the desired relative motion may be used. For example, the lead screw and nut may be replaced by a rack and pinion system, a pulley and belt drive, or, where the desired motion is a linear motion, a linear actuator.

FIG. 20 is a front view showing a drying apparatus including a bar 200 and a second bar 300 according to another exemplary embodiment of the present invention.

Referring to FIG. 20, a drying apparatus 10 may comprise a bar 200 and a second bar 300. The second bar 300 may include a third air outlet 301 and may be moveably driven relative the body 100. The second bar 300 may be associated with its own nut 43, and the nut 43 with its own lead screw 42. The nut 43 is fixed to its own bracket assembly 48 such that the second bar 300 may be driven relative the body 100. The lead screw 42 may be driven by its own motor 52. The components associated with the driving of the second bar 300, and the functionality thereof, are similar to that described above with respect to the bar 200, and thus further description will be omitted in order to avoid duplicate description.

Based on the configuration of the exemplary embodiment described above, those skilled in the art will readily appreciate that even more bars may be employed in the drying apparatus 10. The drive apparatus 11 may be modular to accommodate multiple bars at the body 100.

As an example, as shown in FIG. 20, the bar 200 is associated with its own motor 50, lead screw 40, nut 41, and bracket assembly 44. By operation of the motor 50, the lead screw 40, and the nut 41, the bar 200 moves up and down relative to the body 100. Similarly, the second bar 300 is associated with its own motor 52, lead screw 42, nut 43, and bracket assembly 48. By operation of the motor 52, the lead screw 42, and the nut 43, the second bar 300 moves up and down relative to the body 100. The motor, the lead screw, the nut, and the bracket assembly associated with one bar do not act on the other bar. That is, the motor, the lead screw, the nut, and the bracket assembly of one bar only operate on that bar.

Accordingly, with each additional bar, a corresponding motor, a lead screw, a nut, and a bracket assembly may be added to the drive apparatus 11 to accommodate that bar. In this manner the drying apparatus 10 may be configured with a number of bars on the body 100 according to the preference of the user. Alternatively, each drive apparatus may accommodate more than one bar spaced apart from each other, which move in unison along the longitudinal length of the body 100.

FIG. 20 shows the bar 200 and the second bar 300 using the same guide track(s). In alternative exemplary configurations, the bar 200 and the second bar 300 may use separate guide tracks. By this configuration the bar 200 or the second bar 300 may be operated to any desired location along the extent of its drive path, irrespective of the position of the bar 200 or the second bar 300.

Figure 21A:
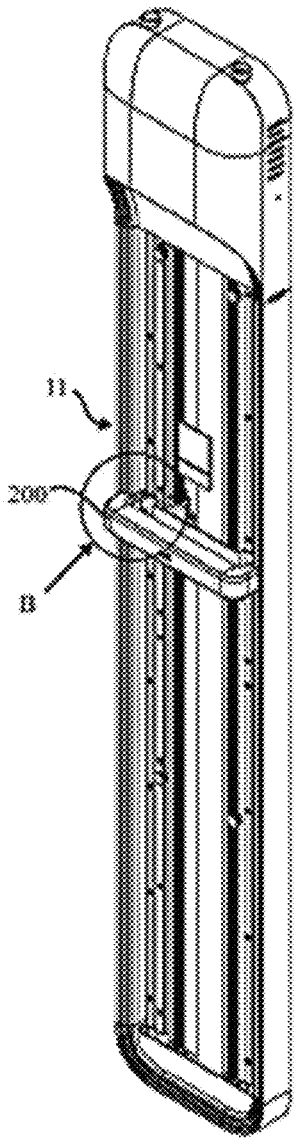
FIG. 21A is a perspective view showing a driving apparatus for a drying apparatus according to an alternative embodiment of the present invention.
Figure 21B:
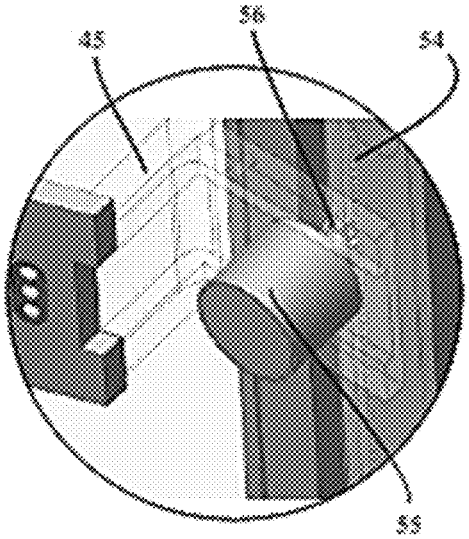
FIG. 21B is a close up view of the portion B of FIG. 21A.
Figure 21C:
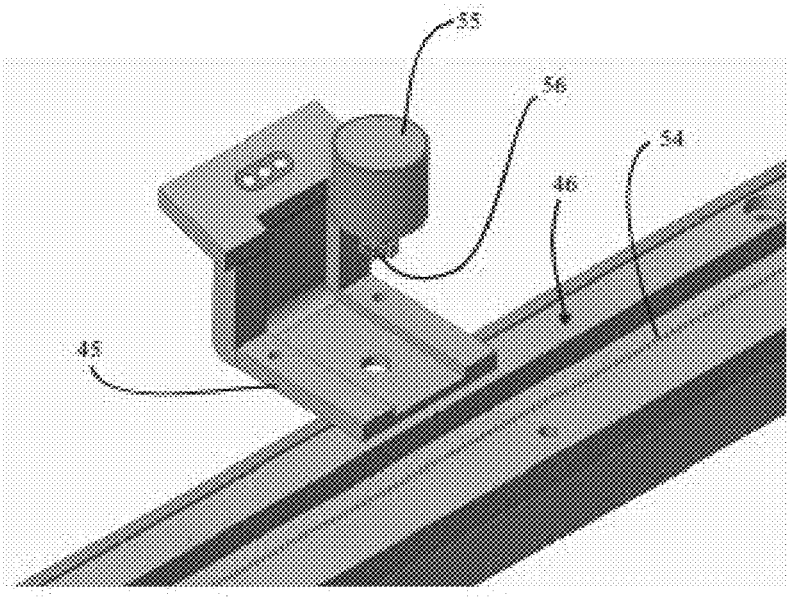
FIG. 21C is a perspective view showing a portion of the driving apparatus of FIGS. 21A-21B.

FIG. 21A is a view showing a rack and pinion drive assembly according to an alternative embodiment of the present invention; FIG. 21B is a close up view of the rack and pinion drive assembly of the portion B; FIG. 21C is an exploded view of the rack and pinion drive assembly of FIG. 21B.

Referring to FIGS. 21A, 21B, and 21C, the second body 200 may move up and down along the elongate height of the first body 100 driven by a rack and pinion assembly. The rack and pinion assembly may comprise a rack 54, a stepper motor 55, and a pinion gear 56 coupled to the stepper motor 55. The rack 54 may be provided vertically along a side of the first body 100. However, the rack may be provided at any location of the first body 100. For example, the rack may be provided longitudinally at the center of the first body 100. In another embodiment, the rack may be provided vertically at a side surface of the first body 100.

In the present embodiment, the rack 54 runs vertically along a side of the first body and has a length covering the traveling distance of the second body 200. The rack may be provided at only one side of the first body 100. In present embodiment, the rack is provided at both sides of the first body 100. Having the rack at both sides of the first body 100 may provide for the second body 200 to travel more stably across the first body 100.

The second body 200 may include a guide member 45 installed at either side of the second body 200 (see also FIGS. 19A-19D and 20). In another embodiment, the second body 200 may use only one guide member 45 to correspond to a drying apparatus using a single rack. The guide members 45 of the second body 200 may be movably installed in corresponding guide tracks 46 located at the first body 100. Each guide track 46 may be disposed adjacent to a corresponding rack. As the second body 200 moves up and down with respect to the first body 100, the guide tracks 46 keep the second body 200 in a predetermined path through the guide members 45.

The stepper motor including the pinion gear may be installed at the guide member 45. The rack may include a plurality of teeth running along a surface of the rack which may correspond to the traveling distance of the second body 200. The pinion gear at the stepper motor meshes with the teeth of the rack to move the second body 200 along the rack. The stepper motor 55 powers the movement of the second body 200. For example, when the stepper motor 55 is rotated clockwise, the second body 200 may move up the rack. When the stepper motor is rotated counter clockwise, the second body may move down the rack.

In the present embodiment, one stepper motor 55 may be installed in one guide member 45 to move the second body 200 with the other guide member 45 purely acting as a guide in the other guide track 46. Another rack may be installed at the other side of the first body and may include a plurality of teeth. In this configuration, a free rotating pinion gear may be provided at the other guide member 45 to mesh with the teeth of the other rack. Having two guide members 45 working in tandem with two racks may provide for an even support at both ends of the second bar 200. In another embodiment, the two pinion gears may be tethered together and be operated by one stepper motor. Alternatively, two stepper motors may be used to operate respective pinion gears.

In a distributed drying arrangement 800 a primary drying module 801, 801' may include a rack and pinion drive assembly as described in relation to FIG. 21A-21C. Further, when one or more secondary drying modules 802 include a movable bar 200 (FIG. 8), the one or more secondary drying modules 802 may also include the above described rack and pinion drive assembly.

Figure 22:
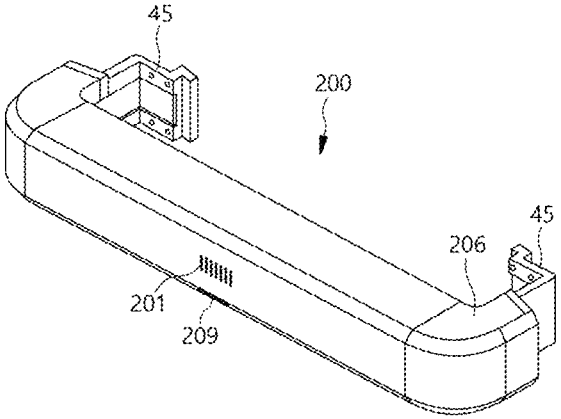
FIG. 22 is a top perspective view of a bar of a drying apparatus according to an embodiment of the present invention.
Figure 23:
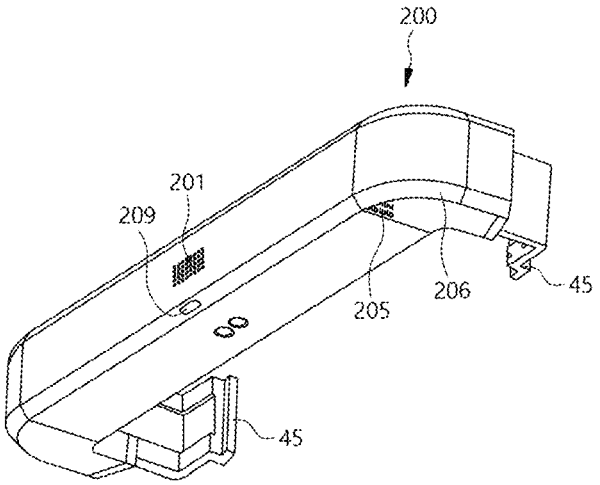
FIG. 23 is a bottom perspective view of the bar of FIG. 22.

FIG. 22 is a top perspective view of the bar 200 according to the present embodiment of the invention; FIG. 23 is a bottom perspective view of the bar 200 according to the present embodiment of the invention; and FIG. 24 is a rear view of the bar 200 according to an alternative configuration to that illustrated in FIG. 23.

Referring to FIGS. 22 and 23, the bar 200 may include a second air outlet 201 in which forced airflow is expelled at different locations relative to the body 100 depending on the location of the bar 200 relative to the body 100. As described previously in relation to the drive apparatus 11 between the bar 200 and body 100, two guide members 45 may guide the bar 200 in its movement relative the body 100.

One or more air inlets 205 may be located at the ends of the bar 200. The air inlet 205 may be protected in a cavity formed between the end of the bar 200 and a shield 206. The shield 206 may extend from the end of the bar 200 to form a shield at the top and side surfaces thereof except for the bottom surface. The open bottom surface of the shield 206 allows for the air inlet 205 to access inlet air. This configuration may act to prevent drips or splashes of water from entering the air inlet 205. The air inlet 205 provides for inlet air to enter into the bar 200 which houses one or more flow generators 204 (see FIG. 25).

Figure 24:
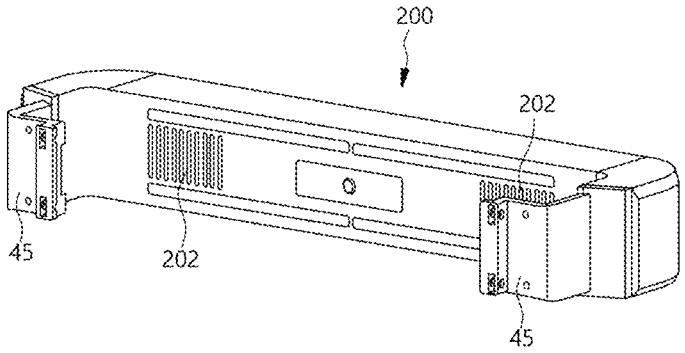
FIG. 24 is a rear view of a bar according to another embodiment of the present invention.

FIG. 24 illustrates two air inlets 202 located at a back side of the bar 200 for supplying air to be vented from the second air outlet 201. In contrast, the air inlets 205 in the configuration of FIG. 23 are located at each end of the bar 200, as explained above. As the bar 200 extends laterally towards a user, more so than the body 100, the bar 200 may be more likely to become wet due to its closer proximity to the user. It may thus be desirable that the one or more air inlets 202 are disposed away from the user. As such, in the configuration of FIG. 24, the air inlets 202 are provided on the back side of the bar 200, as previously explained.

Figure 25:
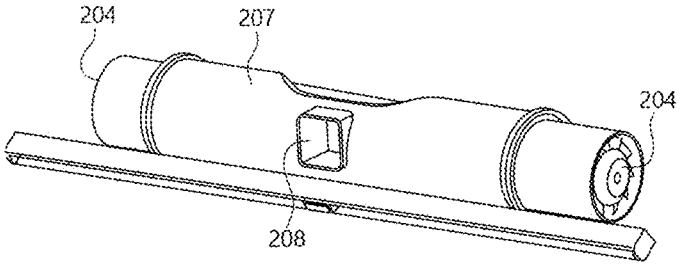
FIG. 25 is a partial view of various internal parts of the bar of FIGS. 22-24 according to an embodiment of the present invention.

FIG. 25 is a partial view of various internal parts of the bar 200 according to an embodiment of the present invention. In particular, FIG. 25 shows the bar 200 with its cover removed to reveal a pair of flow generators 204 and an air conduit 207. The bar 200 may include a pair of flow generators 204 that receives inlet air from the air inlets 202 and generates forced airflow through the air conduit 207. The air conduit 207 may include an intermediate outlet 208 through which the forced airflow may pass and be vented out by the second air outlet 201.

Figure 26:
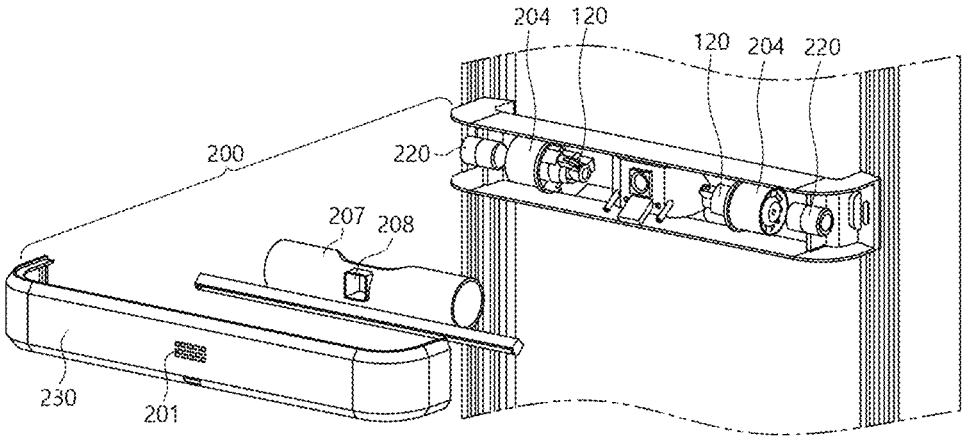
FIG. 26 is an exploded view of various parts of the bar of FIGS. 22-25 according to an embodiment of the present invention.

FIG. 26 is an exploded view showing various parts of the bar 200 according to the embodiment of the present invention described above with respect to FIG. 25.

Referring to FIG. 26, the bar 200 has its cover 230 removed to show various internal parts including a pair of flow generators 204, a pair of motors 220, a pair of thermal devices (for example, resistance heaters, thermoelectric devices, and other suitable devices could be used), and an air conduit 207. The bar 200 has a pair of flow generators 204 which receive inlet air from one or more air inlets (see FIGS. 23 and 24). The pair of flow generators 204 generate forced airflow from the received air which has a relatively high speed. For example, the flow generator may be Smart Inverter Motor™ that sucks in air and expels air at high speed by operating up to 115,000 RPM. However, other types of axial fan assembly may be used.

The forced airflow from the pair of flow generators 204 pass through the air conduit 207 to be expelled from the intermediate outlet 208. The air conduit 207 is shown to be cylindrical but is not limited to this shape and other configurations may be used such as an oval tube, a square tube, a rectangular tube, etc. The air conduit 207 contains the air sucked in by the pair of flow generators 204 within the confines of the air conduit 207 thereby increasing the speed of the forced airflow if not maintaining the speed of the forced airflow expelled by the pair of flow generators 204. Thus, a forced airflow of relatively high speed is introduced into the intermediate outlet 208. The expelled air is ultimately forced out of the second air outlet 201. While the present embodiment illustrates using a pair of flow generators, in other configurations a single flow generator or more than two flow generators may be used.

In the present embodiment, a pair of resistance heaters 120 are shown as part of the bar 200. A resistance heater 120 is located downstream of each of the flow generators 204. In alternative configurations, the resistance heater may be located upstream of the flow generator or may be integrated with the flow generator. In the present embodiment, the flow generators 204 and resistance heaters 120 are at least partially enclosed within the air conduit 207 (see FIG. 25). The air conduit 207 may guide the air heated by the resistance heaters 120 towards the intermediate outlet 208 and out through the second air outlet 201.

While this embodiment uses resistance heaters to heat the inlet air flow, in another exemplary embodiment, a thermoelectric device, for example, using the Peltier effect may be used to heat or cool the inlet air flow. In this configuration, the bar 200 is not limited to expelling heated air but may also expel cold air.

The bar 200 may further comprise one or more motors 220. As shown in FIG. 26, one or more motors 220 may be provided along a longitudinal axis of the bar 200 which may be parallel to the drying face 14 of body 100. The one or more motors 220 may cause the bar 200 to tilt up or down by rotating about its longitudinal axis. By tilting the bar 200 up or down, the bar 200 may expand the coverage area to which the forced airflow may be applied. Also, by tilting the bar 200 up and down continuously while blowing forced air, the bar may enhance drying performance.

Figure 27:
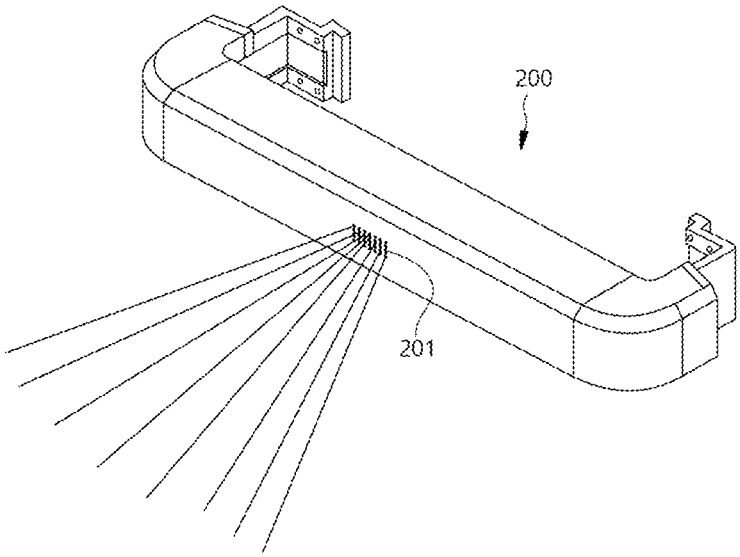
FIGS. 27 and 28 are views showing exemplary ways in which forced air may be expelled from the bar of FIGS. 22-26 according to embodiments of the present invention.
Figure 28:
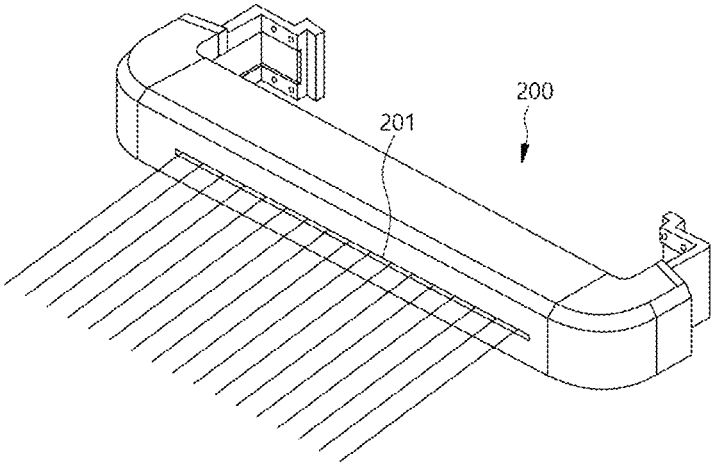

FIGS. 27 and 28 are views illustrating exemplary ways in which forced air may be expelled from the second air outlet 201, according to exemplary embodiments of the present invention, based on the shape and/or size of the second air outlet 201.

The second air outlet 201 may be configured such that the expelled airflow may cover a width of the user as the bar 200 moves up or down along the length of the user. The bar 200 may be provided with a suitable second air outlet 201 that may direct the forced airflow across the full width of the user.

Referring to FIG. 27, more specifically, the second air outlet 201 may be configured to provide a laterally expanding forced airflow. As the forced airflow flows further away from the second air outlet 201, the forced airflow expands at least horizontally to better cover a width of the user's body. An example of a structure to form an expanding forced airflow is shown in FIG. 26.

The intermediate outlet 208 of the air conduit 207 may be a circular, oval, or quadrilateral air outlet from which the forced airflow may fan out as the air flow travels further from the second air outlet 201. As an example, a circular air outlet may form a relatively narrow but relatively strong forced airflow over a small area of the user's body. A rectangular air outlet may form a relatively wider but relatively weaker forced airflow over a larger area of the user's body.

The degree to which the forced airflow fans out may be determined by the angle of the arc at the intermediate outlet 208. As an example, a narrow arc may form a narrow but strong airflow covering a small part of the user's body. A wider arc may form a wider but weaker airflow covering a wider part of the user's body. The shape of the intermediate outlet 208 and the angle of the arc may be selected depending on a desired effect of the forced airflow over the user's body.

Referring now to FIG. 28, the second air outlet 201 may alternatively be an elongated slit across the longitudinal length (in the lateral direction relative to the longitudinal length of the body) of the bar 200 to expel a planar blade of outlet air. In one configuration, the length of the slit may be sufficient to cover a width of the user's body. In this configuration, as the bar 200 travels vertically up and/or down with respect to the body 100, the forced airflow of the second air outlet 201 may cover all parts of the user's body. For this configuration, the intermediate outlet 208 may be formed as an elongated slit running across the longitudinal length of the air conduit 207. The second air outlet 201 being an elongated slit as shown in FIG. 28 corresponds to the slit of the intermediate outlet 208.

FIG. 29 is an electrical schematic diagram of a drying apparatus 10 according to an embodiment of the present invention. A controller 53 controls the overall operation of the drying apparatus 10. The controller 53 may be a microprocessor, an integrated circuit, an electrical circuit, a logical electrical circuit, and the like.

The controller 53 may control the operation of the body flow generator 110 and the thermoelectric device 117 of the body 100; the controller 53 may control the operation of the flow generator 204 and the resistance heater 120 associated with the bar, and may control the motor 220, among others. The various operations which are performed by the components have been described above and further description will be omitted. The controller 53 may access or store information in a memory 58 for controlling the operation of the drying apparatus 10.

The drying apparatus 10 may include one or more sensors 209 which are also controlled by the controller 53. These sensors 209 may variously be associated with the body 100 and the bar 200 (e.g., FIGS. 19C and 23). In some embodiments, one or more sensors 209 may be located remotely from the drying apparatus 10.

According to various embodiments, such as the embodiments shown in FIGS. 19C and 23, for example, the one or more sensors 209 may be associated with the bar 200. The controller 53 may receive sensor information from the one or more sensors 209 of the bar 200 and the controller 53 may operate the drying apparatus 10 utilizing the sensor information as an operation parameter.

As an example, sensing information of the one or more sensors may be utilized by the controller 53 to determine various characteristics of the environment surrounding the apparatus and/or various characteristics and/or conditions of a user. For example, the sensing information may be utilized to determine the presence of a user; physical characteristics of the user including their overall and/or particular dimensions; wetness of a user's body and/or different parts of their body; temperature or heat of the ambient air and/or humidity of the ambient air, among others. To achieve this, the drying apparatus 10 may include one or more sensors 209 described below.

The one or more sensors 209 may include a thermal sensor such as an infrared sensor. The infrared sensor may be used to obtain information on the heat of the surroundings. For example an infrared sensor may be used as a temperature sensor to sense the temperature of the ambient air. Information on the temperature of the ambient air may be obtained to determine whether to condition the ambient air.

The infrared sensor may be used on a user's body located adjacent to the drying apparatus 10. Information from the infrared sensor may be utilized to infer or determine moisture levels of the user's body, and/or specific parts of the user's body. Information from the infrared sensor may be utilized to obtain an indication of the overall dimensions of a user's body, where body temperature differs from the temperature of the surrounding air.

The one or more sensors 209 may include a proximity sensor. The proximity sensor may be utilized to determine the proximity of the user to the drying apparatus 10. For example, information from the proximity sensor may be utilized to determine the distance of the user from the drying face 14 of the drying apparatus 10. When the user is within a predetermined distance of the drying face 14, the drying apparatus may be activated to dry the user. Information from the proximity sensor may utilized to control a forced airflow speed from the air outlet 101 and/or the air outlet 201 dependent on the distance of the user, in order to obtain a desired forced airflow speed directed at the user.

The proximity sensor may be utilized to determine if a user is undesirably close to the drying apparatus or a part thereof. For example, for safety reasons, it may be desirable to limit or prevent the movement of the bar 200 when a person is within a particular distance or position relative to it. This may include where part of a person's body is located above or below the bar 200, within its path of movement.

The one or more sensors 209 may include an image sensor. The image sensor may be utilized to obtain image information of the surroundings, determine the presence of a user, and determine overall dimensions of a user's body and/or specific parts of the user's body. The image sensor may be used in conjunction with or in lieu of the thermal sensor for information such as those mentioned above in order to obtain a more accurate information.

The one or more sensors 209 may include a humidity sensor. The humidity sensor may also be utilized to obtain information on the humidity of surrounding ambient air, for example, a humidity level of the bathroom in which the drying apparatus is installed. The drying apparatus 10 may be activated or used to remove moisture in the air until the humidity level is below a predetermined level. The humidity sensor may also be utilized to obtain information regarding the level of wetness/dryness of the user's skin. The information may be used to control heat applied to the forced airflow so that the user's skin does not become too dry.

Besides the exemplary sensors described above, other sensors known in the art may be used to achieve a desired result.

As previously mentioned, the drying apparatus 10 may perform air conditioning of a given space. For example, the space may be a bathroom. During hot days, the drying apparatus 10 may cool the bathroom and during cold days the drying apparatus 10 may heat the bathroom for the comfort of the user. In such a scenario, the controller 53 may determine the ambient temperature or ambient heat level of the bathroom, and use this information to control the temperature to the satisfaction of the user. It should be noted that in the distributed drying arrangement 800, 800', similar operations may be performed. For example, where the controller 530 operates autonomously, the controller 530 may make the determination performed by the controller 53 as above. However, the controller 530 controls the operation of the secondary drying module 802 to control the temperature. Otherwise, where the controller 530 receives control information from the controller 53, the controller 530 may operate the secondary drying module or modules 802 under the control of the controller 53 to control the temperature.

For example, in a hot bathroom, the user may perspire to keep cool. The perspiration evaporates taking some of the heat from the user's body providing a sensation of coolness. However, when the humidity level is high in the bathroom, the perspiration does not evaporate as efficiently and thus remains as moisture on the user's body. This may cause discomfort to the user as the user feels hotter than the temperature of the bathroom.

Accordingly, the controller 53 and/or controller 530 in conditioning the bathroom may need to consider the temperature as well as the humidity. In one embodiment, the controller 53 and/or controller 530 may consider a comfort level index correlating temperature and humidity to determine user comfort. The temperature-humidity index (THI), also known as the discomfort index, may be used to determine a comfort sensation with respect to the current sensed temperature and the current sensed humidity.

There are several equations devised to determine THI. One equation may be:

$$THI = T_d - (0.55 - 0.55RH)(T_d - 58)$$

where $T_d$ is the dry-bulb temperature in ° F., and RH is the relative humidity in percent, expressed in decimal. For example, 50% relative humidity is 0.5.

It should be noted that the THI is not absolute but relative. Temperatures affect people differently. Various factors such as height, weight, sex, health condition, etc., may cause one person to feel temperature differently than another person.

Below is a table that illustrates a THI which reflects the comfort level of a typical person.

| Level | THI Range | Comfort Level |
|---|---|---|
| Very High | Above 80 | Everyone experiences discomfort |
| High | Between 75 and below 80 | 50% experiences discomfort |
| Normal | Between 68 and below 75 | Discomfort begins to be felt |
| Low | Below 68 | No discomfort is felt |

Figure 30:
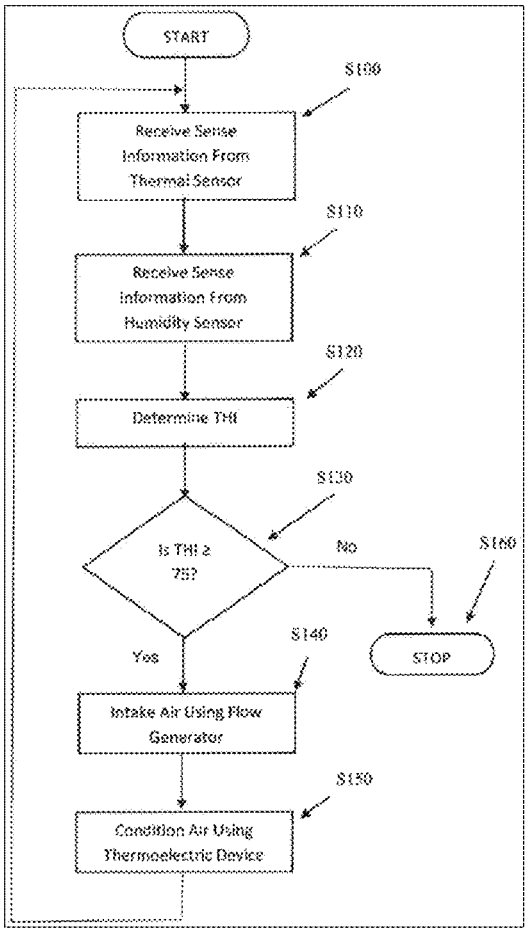
FIG. 30 is a flowchart for control of temperature-humidity index (THI) by a controller according to one embodiment of the present invention.

FIG. 30 is a flowchart illustrating a method for controlling temperature of a given space using a temperature-humidity index (THI), by the controller 53 and/or controller 530, according to one embodiment of the present invention. The controller 53 controls the operation of the primary drying module 801 and the controller 530 controls the operation of the secondary drying module 802. To simplify the description, the controller 53 and/or controller 530 will be referred to as "controller". This will be applicable for the descriptions pertaining to FIGS. 30-33.

Referring to FIG. 30, in step S100, the controller may receive sense information from the thermal sensor. The information may be an ambient temperature of the bathroom. In step S110, the controller may receive sense information from the humidity sensor. The information may be a humidity level of the bathroom. In step S120, the controller may use the received temperature information and the humidity level information to determine the THI. One equation that the controller may use to derive the THI may be the equation provided above. The equation may be stored in the memory to be accessed by the controller.

In step S130, the controller may determine whether the derived THI is greater than or equal to 75. The reference index of 75 may be stored in the memory. It should be noted that the reference index of 75 is not absolute. For example, the reference index of 75 may be increased or decreased in the memory to tailor to individual user's need. If the THI is less than 75 the controller may continue to step S160 where the controller may terminate the control of the THI.

Otherwise, in step S130, if the controller determines that the THI is greater than or equal to 75, the controller may continue to step S140. In step S140, the controller may send a signal to activate the flow generator. The flow generator may be either on or off, i.e., producing a constant air flow. Alternatively, the controller can be configured to control a variable air intake amount by using an air intake amount value corresponding to the desired air flow. For example, the flow generator may be the flow generator located at the body of the primary drying module 801. For example, the flow generator may be the flow generator located at the secondary drying module 802. At step S150 the controller may activate the thermoelectric device. It should be noted that the activation of the flow generator and the thermoelectric device need not be in sequence; it can be simultaneous or in reverse order.

The controller may send a signal to the thermoelectric device 117 to cool (or warm) the air sucked in through the air inlet. The cooled air may reduce the temperature of the intake air as well as dehumidify the air. The cooled, dehumidified air may then be expelled through the air outlet. The controller may be configured to adjust the amount of heating or cooling via a heat level value. The heat level value can correspond to a heat level, either cooler or hotter than the ambient air. The controller continues to step S100 to repeat steps S100 to S130.

At step S130, the controller may again determine whether the THI is greater than or equal to 75. If the controller again determines that the THI is greater than or equal to 75, the controller continues to steps S140 and S150 and continues to intake air and to cool the air. The controller continues unless and until the controller determines at step 130 that the THI is less than 75. In which case, the controller continues to step S160 where the controller terminates the method.

In some instance, the forced airflow provides a wind chill to the user, which the system can also use as a comfort level to adjust air intake and temperature. This is where the user perceives the airflow at a temperature lower than that of the ambient air temperature. There are several equations devised to determine wind chill. For the purpose of this disclosure, reference may be made to the North American and UK wind chill index as follows:

$$T_{wc}=13.12+0.6215T_a-35.75v^{+0.16}+0.4275T_av^{+0.16}$$

where $T_{wc}$ is the wind chill index, based on the Celsius temperature scale; $T_a$ is the air temperature in degrees Celsius; and v is the airflow speed in kilometers per hour.

Based on the above equation, the higher the forced airflow speed the lower the perceived temperature of the air flow by the user. Thus, when airflow speed increases the controller may increase the temperature of the forced airflow to obtain the target temperature.

Embodiments may not have a sensor to determine the airflow speed, but can estimate it due to known constraints within the system. For example, the size of chambers for airflow, the power of the air flow generator, and the size of the outlet for the airflow are all known variables. Therefore, embodiments include estimating the airflow speed based on these known parameters. Embodiments may also include a table that correlates airflow speed with the speed at which the airflow generators operate. Therefore, for a known air flow generator input, the system may know the airflow speed based on corresponding predetermined values. In one embodiment, the target surface skin temperature of the user may be about 30 to about 32 degrees Celsius. Thus forced airflow heating or cooling may be provided to maintain or obtain this temperature.

In one embodiment the temperature of the forced airflow generated by the primary drying module and/or the secondary drying module should be at a temperature that provides little or no discomfort to the user. The Humidex index of apparent temperature may provide a suitable guide on the level of comfort or discomfort provided by a temperature applied to a user's skin. The Humidex index takes into account both temperature and relative humidity in determining the level of comfort or discomfort. The humidex formula is as follows:

$$H = T_{air} + \frac{5}{9}\left[6.11e^{5417.7530\left(\frac{1}{273.16}\cdots\frac{1}{273.15+T_{dew}}\right)} - 10\right]$$

Where H denotes the Humidex, $T_{air}$ is the air temperature in ° C., and $T_{dew}$ is the dew point in ° C.

In some embodiments, the apparent temperature to be applied to the user is between 20 to 39° C. In a preferred embodiment, the apparent temperature to be applied to the user is between 20 and 29° C. As mentioned above, the apparent temperature may be determined by taking into account the wind chill factor of the airflow temperature.

Figure 31:
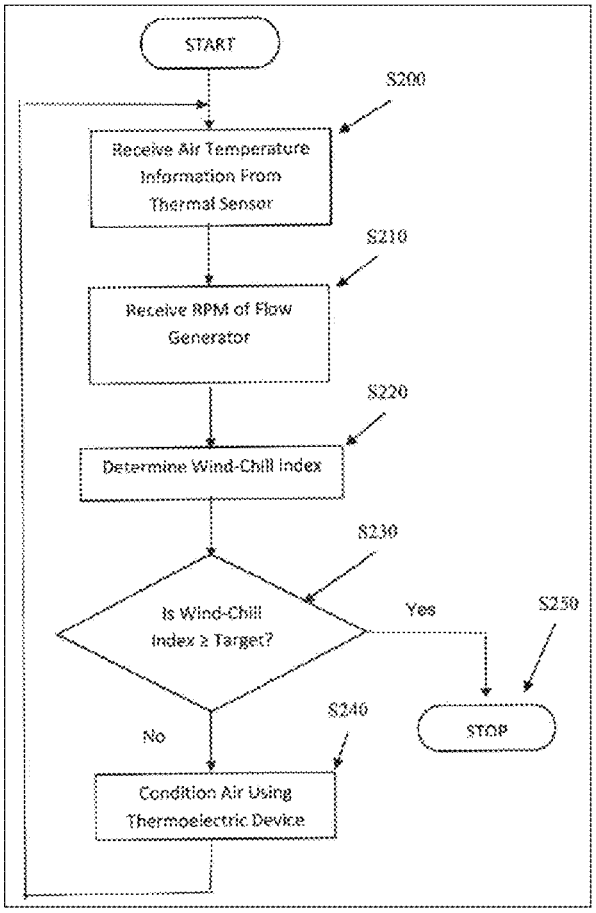
FIG. 31 is a flowchart for control of wind chill index by a controller according to one embodiment of the present invention.

FIG. 31 is a flowchart illustrating a method for controlling temperature using a wind chill index, by the controller, according to one embodiment of the present invention.

Referring to FIG. 31, the controller may control the flow generator to direct forced airflow to the user's body through the air outlet based on the thermal sensor information and a wind-chill index. At step S200, the controller receives information from the thermal sensor. The information may for example, reflect an air temperature in the vicinity of the bar of the primary drying module and/or the secondary module where the respective thermal sensor may be located.

In step S210, the controller receives the revolutions per minute (RPM) of the flow generator. In this configuration, the RPM of the flow generator is variable. In a configuration where the flow generator is not variable, but fixed, the controller may retrieve the RPM stored in the memory. The RPM of the flow generator is equated to an airflow speed of the forced airflow.

In step S220, the controller, having the air temperature at the bar and/or the secondary drying module and the airflow speed of the forced airflow, may determine the wind chill index. One equation that the controller may use to derive the wind chill index may be the equation provided above. The equation may be stored in the memory where it is accessed by the controller.

In step S230, the controller determines whether the derived wind chill index is greater than or equal to a predetermined target. The predetermined target may be chosen from among many different temperatures or temperature ranges. For example, the target may be the target surface skin temperature of about 30 to about 32 degrees Celsius. The target may be stored in the memory 58.

If the wind chill index is less than the target, the controller may continue to step S240. In step S240, the controller may increase the temperature of the forced airflow by heating the air flow using the resistance heater at the bar and/or the secondary drying module, for example. The controller may continue to step S200 and then repeat steps S200 to S230. Since the thermal sensor is close to the air outlet, the thermal sensor may sense an increase in temperature. Also, step S210 may be skipped where the RPM of the flow generator does not change.

As indicated, the controller repeats the process unless and until the controller determines, at step S230, that the wind chill index is greater than or equal to the target. If the wind chill index is greater than or equal to the target, the controller continues to step S250, deactivates the resistance heater and terminates the method.

Figure 32A:
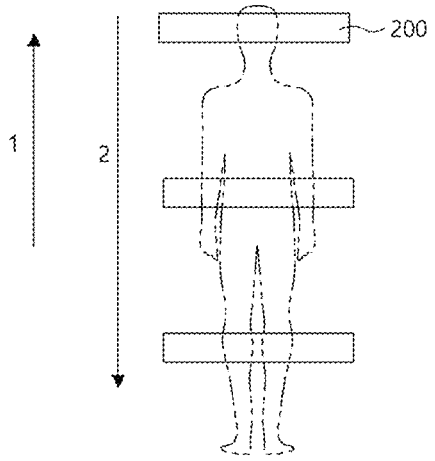
FIGS. 32A and 32B are schematic illustrations showing a user being dried with a bar of a drying apparatus according to an embodiment of the present invention.
Figure 32B:
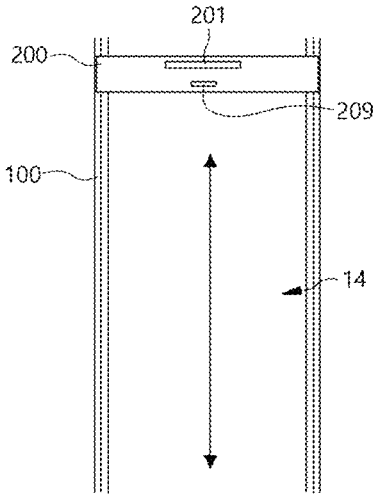

FIGS. 32A and 32B are views illustrating a user being dried by the bar of the primary drying module and/or the secondary drying module according to an embodiment of the present invention.

Referring to FIGS. 24A and 24B, the bar and/or the secondary drying module includes a sensor which may be a thermal sensor positioned such that it faces the user when the user is present at the distributed drying arrangement. In the case where a bar is used for both the primary drying module and the second drying module as in the distributed drying arrangement 800', the bar may be located at any position along the longitudinal length of the user's body. While the bar configuration for the primary drying module and the secondary drying module are used as illustration, the present embodiment is not limited thereto. To simplify the description, the bar of the primary drying module and/or the bar of the secondary drying module will be referred as "bar". In should be noted that the bar of the primary drying module may move independently of the bar of the secondary drying module, or the bars move in sync (for example, one bar mimics the movement of the other bar) with respect to each other. In the present embodiment, the starting position of the bar may be somewhere approximating a middle portion of the user's body. When the distributed drying arrangement is activated, the bar may be driven upward in the direction of arrow 1. Coincidently, the thermal sensor may be activated.

As the bar is driven upward, the thermal sensor scans the user. When the thermal sensor no longer detects thermal heat from the user, then the height of the user is determined to have been reached and the movement of the bar may be stopped. The bar may then move downwards in the direction of arrow 2. At the same time the thermal sensor scans the user. The thermal sensor may operate to detect wetness at the part of the user being scanned. The thermal sensor may detect wetness on the user as being a cooler temperature and dryness as being a warmer temperature. The flow generator and perhaps the resistance heater may be activated to dry the user.

In another configuration, the flow generator and perhaps the thermoelectric device may be activated to dry the user. The flow generator and the resistance heater or thermoelectric device 117 may be continuously operated until the bar has reached the bottom of the user and then the flow generator and the resistance heater or thermoelectric device may be deactivated.

As shown in FIG. 32A, the bar may be positioned by the head of the user. Because hair usually retains a lot of water, the thermal sensor may detect significant wetness when the bar is in this position. Accordingly, the bar may not move while the air outlet expels heated forced airflow to dry the user's head. When the thermal sensor detects that the user's head is sufficiently dry the bar moves downwards in the direction of the arrow 2.

As the bar moves downward in the direction of the arrow 2, the heated forced airflow expelled from the air outlet may dry the head, the body, and eventually the legs. While the bar is transitioning from the head to the legs, the bar may stop, dry parts of the user which are more wet than other parts, before moving further down in the direction of arrow 2, until the bar has reached to the bottom of the user.

In another embodiment, the bar, after initially reaching the head of the user, may move up and down repeatedly from head to toe until the thermal sensor senses that the user is dry. The movements of the bar described are exemplary and other forms of movement of the bar to dry the user may be conceived.

Figure 33:
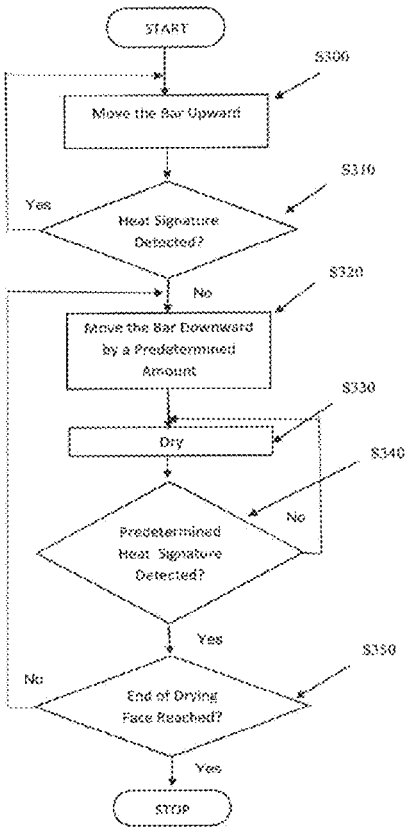
FIG. 33 is a flowchart for drying of a user by the controller according to an embodiment of the present invention.

FIG. 33 is a flowchart illustrating an exemplary method for drying a user, by the controller, according to an embodiment of the present invention.

Referring to FIG. 33, in step S300, the controller 53 moves the bar upward with respect to the user's body. The controller also receives heat information from the thermal sensor. In step S310, the controller determines whether the thermal sensor detects heat. If the thermal sensor detects heat, the controller continues to move the bar upward in step S300. Otherwise, if the thermal sensor does not detect heat, the controller stops the movement of the bar, on the assumption the bar has reached the height of the user, and continues to step S320.

In step S320, the controller moves the bar downward by a predetermined amount, such as one width of the user's body covered by the forced airflow from the bar. In step S330, the controller operates the flow generator. In this step, the controller may also activate the flow generator and perhaps the resistance heater. Thus forced airflow from the air outlet may dry a corresponding part of the user adjacent to the bar. The controller then continues to step S340.

In step S340, the controller determines whether the thermal sensor detects heat greater than or equal to a predetermined amount. The predetermined amount may indicate that the part of the user is sufficiently dry. If the thermal sensor detects heat less than the predetermined amount, the controller continues with step S330 where the controller continues to dry corresponding the part of the user. Otherwise, the controller continues to step S350.

In step S350, the controller determines whether the bar has reached the bottom of the user. If the bar has not reached the bottom of the user, the controller continues to step S320, and repeats steps S320 to S340. Otherwise, if the bar has reached the bottom of the user, the controller deactivates the flow generator and the resistance heater.

Figure 34:
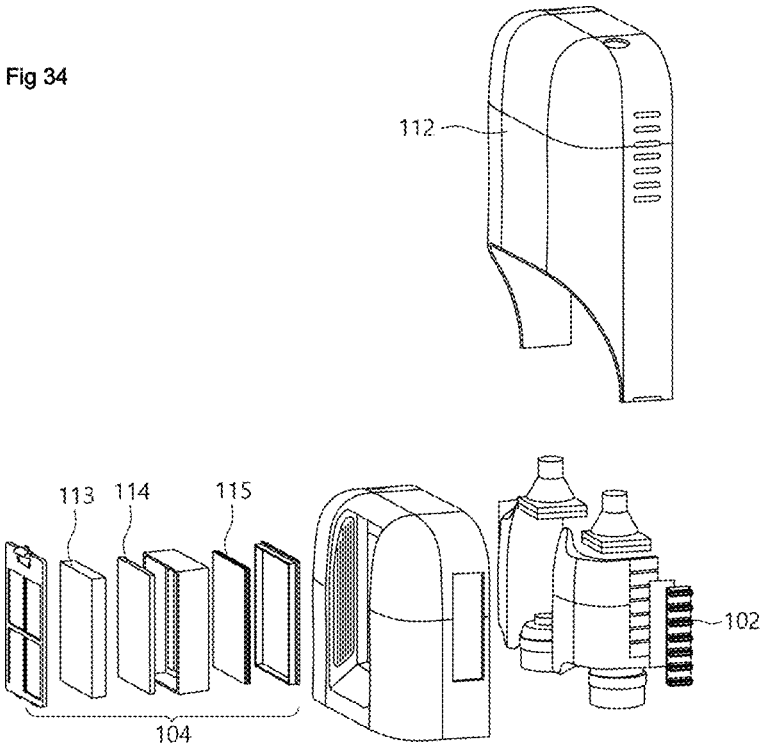
FIG. 34 is an exploded view of an upper region of the drying apparatus showing an exploded view of a filter unit according to an embodiment of the present invention.
Figure 35:
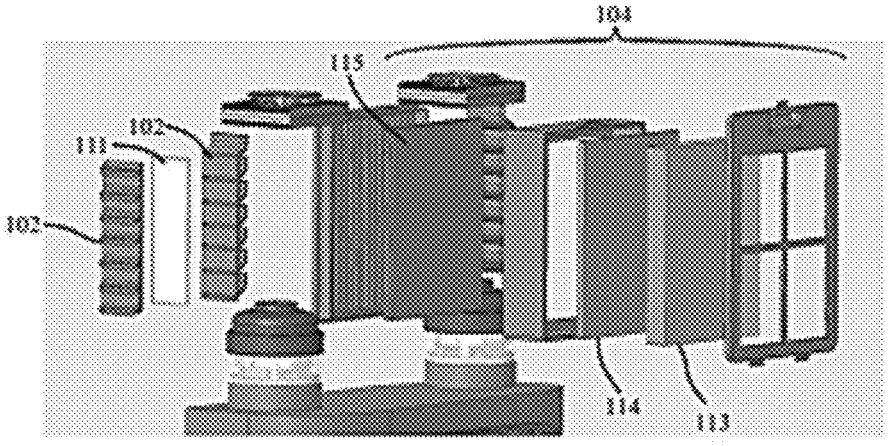
FIG. 35 is another exploded view of the filter unit of FIG. 34 according to an embodiment of the present invention.

FIG. 34 is an exploded view of an upper region of the drying apparatus 10 illustrating an exploded view of a filter unit according to an embodiment of the present invention; and FIG. 35 is another exploded view of the filter unit according to an embodiment of the present invention.

As alluded to previously, the foregoing principles and arrangements apply not only to drying apparatus 10, 10' of the primary drying module 801, 801', but can also be applied to the secondary drying modules 820 as well.

The filter unit 104 may provide one or more filtrations or treatments to inlet air flow. Ambient air, particularly in cities or other urban settings, may contain undesirable levels of particulate matter. Such particulate matter may be harmful to a person's health, and may also have undesired effects on a person's skin if blown onto the person when using the drying apparatus to dry their body.

For example, particulate matter may be either basic or acidic, and thus cause damage to a user's body. The filter unit 104 may comprise one or more particulate filters 113, such as is seen in FIG. 35, to capture particulate matter. The one or more particulate filters 113 may be in the form of any commonly available filter, for example, a fiberglass filter, a polyester filter, or a High Efficiency Particulate Air (HEPA) filter.

Ambient air is also likely to contain bacteria and viruses, which may pose a risk of infection to a user of the drying apparatus. If not entrained by a particulate filter 113, a filter unit 104 may include a bacterial and/or viral filter 114. Such a filter may include antimicrobial or antibacterial elements.

It may be desirable to reduce or remove moisture in inlet air before it is vented for drying. The filter unit 104 may include one or more dehumidifying filters 115, having for example a desiccant material.

In the present embodiment, a pair of air inlets 102 each pass the inlet air to the filter unit 104. The use of a single filter unit 104 may be desirable particularly where there are multiple flow generators to provide for a single point of servicing of any filters within the filter unit.

Figure 36:
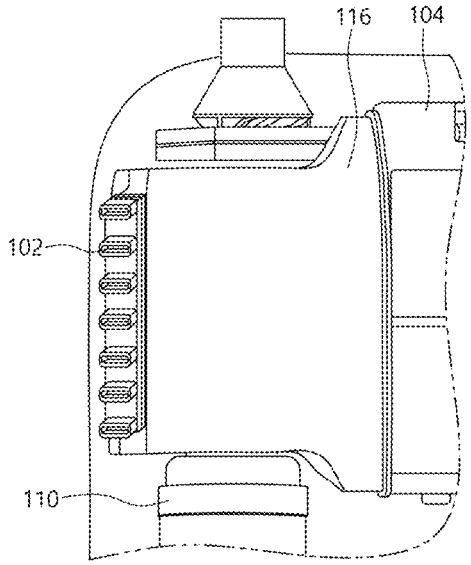
FIG. 36 is a front view of an air inlet and an inlet pathway at a flow generator housing according to an embodiment of the present invention.
Figure 37:
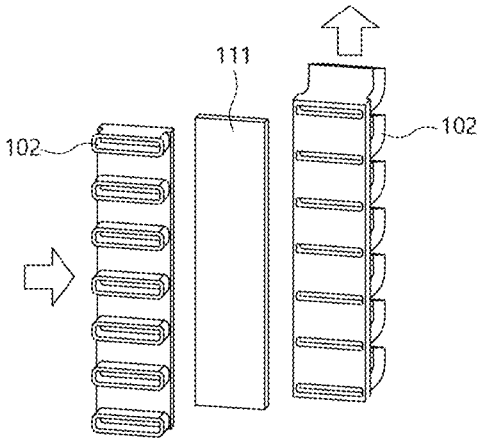
FIG. 37 is a partial exploded view of the air inlet of FIG. 36.

FIG. 36 is a front view of an air inlet and an inlet pathway at a flow generator housing according to an embodiment of the present invention; and FIG. 37 is an exploded view of the air inlet of FIG. 36.

Referring to FIG. 36, an inlet pathway, which involves the air inlet 102 and the flow guide 116, directs inlet air from the air inlet 102 to the filter unit 104. However, because the drying apparatus 10 may be used in a wet environment, such a bathroom or shower, water may be splashed onto the drying apparatus 10 or into the air surrounding the drying apparatus 10, including the air inlets 102. Additionally, in use, there may be suction at the air inlets 102 due to operation of the flow generators 110 which could pull nearby water into the air inlets 102. It is undesirable that such water enters the drying apparatus 10. In addition to water making its way into the air inlets 102, the flow path may intake other matter passing through the air inlets 102 and into the flow guide 116.

As shown in FIGS. 36 and 37, the air inlets 102 provide for an upwardly deflected flow path into the flow guide 116. This upward deflection may act as a gravitational barrier to the ingress of water or other solid objects into the drying apparatus 10. To further prevent unwanted water or other matter passing into the flow path, an obstruction in the inlet flow path may additionally or alternatively be provided in the form of an inlet filter 111, for example as seen in FIG. 37. This inlet filter 111 may, more specifically, be in the form of a particulate filter, for filtering particles from the inlet air.

Alternatively the inlet filter 111 may be in the form of a macroscopic filter, such as a macroscopic mesh filter for guarding against the inletting of larger matter. Where it is desired to guard against water being drawn in with the inlet air or to dehumidify the inlet air the inlet filter 111 it may include a desiccant material for absorbing water.

As a further measure to dehumidify the inlet air, a resistance heater (not shown) may be placed adjacent to the inlet filter 111. When operated, the resistance heater may heat the inlet air to remove moisture in the air. Further, the resistance heater may remove moisture in the inlet filter 111 to increase the life of the inlet filter 111.

Figure 38:
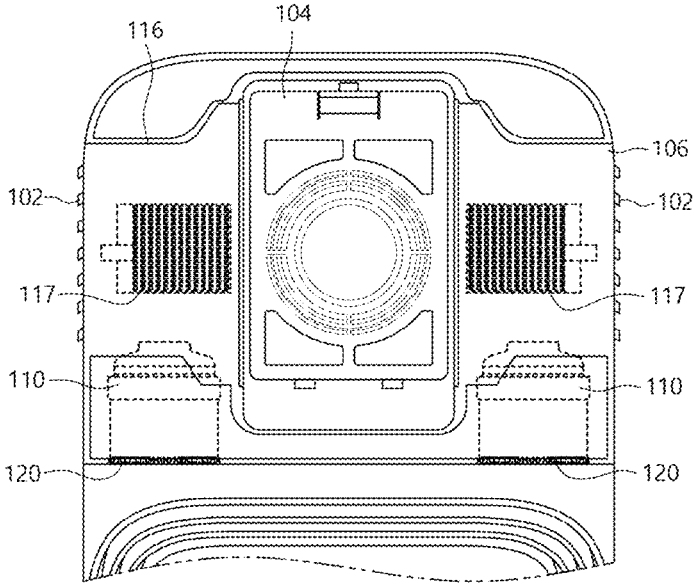
FIG. 38 is a front transparent view of an upper region of a drying apparatus according to another embodiment of the invention.

FIG. 38 is a front transparent view of an upper region of a drying apparatus according to another embodiment of the invention. For example, similar to the configuration shown in FIG. 9, a connection between the flow generators 110 and the first air outlet 101 of the body 100 is such that the outlet of each of the flow generators 110 directly connects to the first air outlet 101 of the body 100. To provide added comfort for a user and/or increased drying efficiency, it may be desirable to further heat the air heated by the thermoelectric device 117. As seen in FIG. 38, air flowing from the filter unit 104 may pass by one side of the thermoelectric device 117 to be selectively heated or cooled.

While FIG. 38 shows a square shaped thermoelectric device 117 covering a portion of the outlet air flow pathway 105, it should be appreciated that the thermoelectric device 117 may be rectangular covering all of the outlet air flow pathway 105. That is, the thermoelectric device 117 may have a rectangular shape that covers all of the filtered air airflow pathway starting from the outlet of the filter unit 104 and ending at the inlet of the flow generator 110. Where the air is to be further heated, it may be desirable to heat the heated air downstream of the flow generator 110.

Thermal elements such as resistance heaters 120 may be provided at the downstream side of respective flow generators 110. The resistance heaters 120 may further heat the air forced by the flow generators 110 towards the first air outlet 101. The resistance heater 120 may be used as a booster to further heat or super heat the air heated by the thermoelectric device 117.

While in FIG. 38, the thermal elements are shown as resistance heaters, any other suitable thermal elements may be used. In other configurations the thermal element may be a thermoelectric device that may be used to selectively heat or cool the air at the downstream side of the flow generator.

Figure 39:
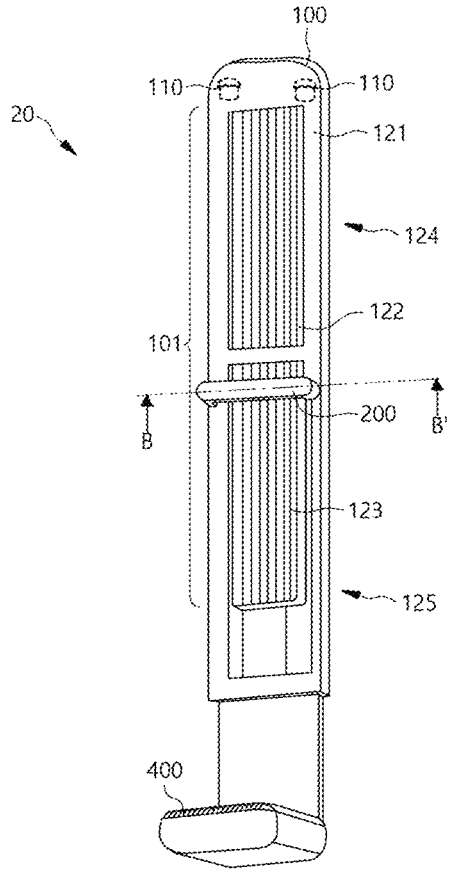
FIG. 39 is a perspective view of a drying apparatus according to an alternative embodiment of the present invention.
Figure 40:
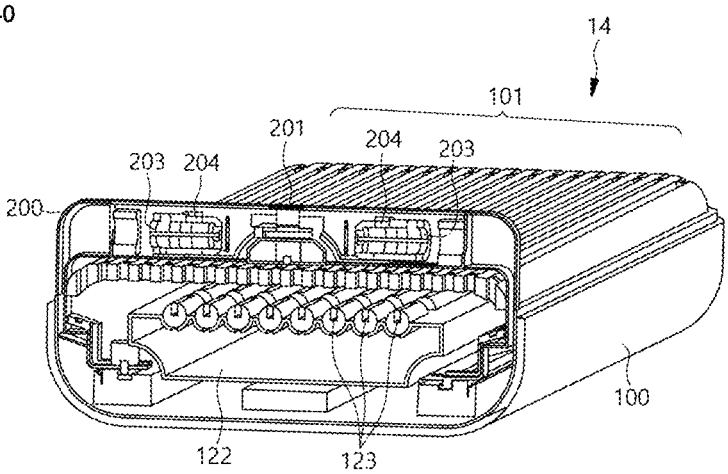
FIG. 40 shows a cross-sectional view along line B-B' of FIG. 39.

FIG. 39 illustrates a view of a drying apparatus 20 according to another exemplary embodiment of the present invention. FIG. 40 shows a cross-sectional view of a body 100 and a bar 200 of the drying apparatus of FIG. 39.

As shown in FIG. 39, in a drying apparatus 20, the first air outlet 101 may be distributed across at least a portion of the drying face of the body 100. Unlike the drying apparatus 10 described above, where the first air outlet 101 runs along a periphery of the body 100, the first air outlet 101 of the drying apparatus 20 includes outlet ducts 123 that are distributed across the face of the drying face 14. In the present embodiment, the outlet ducts 123 are a plurality of vertical slits running along a longitudinal length of the body 100 and disposed across the drying face 14. The outlet ducts 123 are provided in two zones, an upper zone 124 and a lower zone 129. This configuration may allow for differences in venting between different regions of the first air outlet 101.

FIG. 40 shows a cross-sectional view along line B-B' of FIG. 39 through the body 100 and the bar 200 where the first air outlet 101 is a distributed outlet across the drying face 14 of the body 100. In the drying apparatus 20, a pair of flow generators 110 may expel forced airflow to a duct 121 (similar to that shown in FIG. 15), to a duct 122, and finally on to a plurality of outlet ducts 123 from which the forced airflow is vented from the drying apparatus 20. Shown in cross-section is the duct 122 which may receive the forced airflow from the duct 121. The duct 122 may include a plurality of vertical slits running along a longitudinal length of the body 100 corresponding to the vertical slits of the outlet ducts 123. The duct 122 may vent the forced airflow to the plurality of outlet ducts 123 through the plurality of slits which, in turn is vented to the outside of the body 100 by the outlet ducts 123. The duct 122 and the plurality of outlet ducts 123 may comprise the first air outlet 101.

In this embodiment, the bar 200 may receive air from the flow generator or generators 110 of the body 100. For example, the bar 200 may have one or more air inlets, such as air inlets 203 as shown in FIG. 40. One example of a bar 200 having this configuration is shown in FIG. 24. Referring to FIG. 24, the bar 200 having a pair of air inlets 202 at the back side of the bar 200 may receive forced airflow from portions of the plurality of outlet ducts 123 which the pair of air outlets 202 covers. Referring to FIG. 40, the one or more air inlets 203 may receive air from the flow generators 110 in the body 100 and vent the air from the second air outlet 201.

In the present embodiment, the bar 200 is provided with a pair of flow generators 204 that further speeds the forced airflow received from the flow generators 110 of the body 100. However, in other embodiments, the bar 200 is not provided with flow generators 204 and vents the forced airflow received from the flow generators 110 of the body 100 as is. Although not shown, the bar 200 may include resistance heaters 120 as shown in FIG. 26. Although not shown, the bar 200 may include thermoelectric devices instead of resistance heaters. The bar 200 may further air condition the received forced airflow from the body 100. Otherwise, the bar 200 may not include an air conditioning device and may vent forced airflow air conditioned by the thermoelectric devices 117 of the body 100 without further air conditioning the received forced airflow from the body 100.

Referring back to FIG. 39, the drying apparatus 20 may further include a feet resting portion 400 on which a person may place their feet. The duct 122 may continue on to connect to the feet resting portion 400. The duct 122 may supply air flow to one or more air outlets of the feet resting portion 400 through which air vented from the one or more air outlets may dry the feet of the person. In the configuration shown in FIG. 39, the feet resting portion 400 may be configured to retract into the body 100 of the drying apparatus 20, for example, when not in use. However, in other embodiments, the feet resting portion 400 does not retract and may be stationary supported by the floor.

Figure 41:
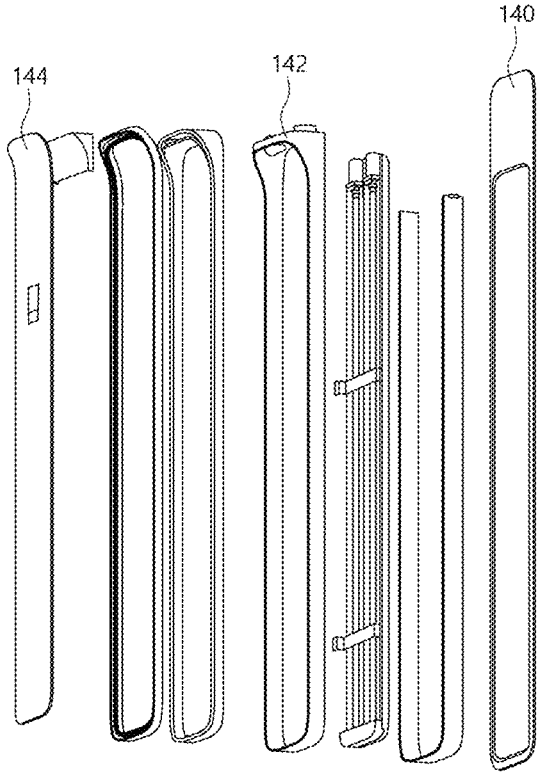
FIG. 41 is an exploded view of components of a drying apparatus according to an embodiment of the present invention.

FIG. 41 is an exploded view of the body according to an embodiment of the present invention.

The body 100 may be covered with molded plastic covering. As shown in FIG. 41, the molded plastic covering may comprise a back panel 140, a side panel 142 and a front panel 144 covering the body 100. In another embodiment, the plastic covering may have a thin metallic plate adhered to its surface. Parts of the plastic covering may be snap fitted together. For example, one part may have a protrusion portion and another part to be fitted to may have a corresponding recess portion. When the two parts are snap fitted together, the protrusion portion fits into the recess portion and the two parts are fixed to each other. The plastic covering form an outer appearance of the body 100 and provide an aesthetically pleasing look. Being snap fitted together, the plastic covering of the body 100 may be removed by pulling the plastic covering off the body 100 and replacing with another plastic covering having a design or pattern meeting the preference of the user, and thereby being customized to the user according to their taste. It should be noted that the plastic covering 230 (see FIG. 26) of the bar 200 may also be removed and replaced with another plastic covering having a design or pattern meeting the preference of the user, and thereby being customized to the user according to their taste.

Exemplary embodiments of the drying apparatus have been described above. Embodiments may be modified for particular usage or suitability.

Where in the foregoing description reference has been made to elements or integers having known equivalents, then such equivalents are included as if they were individually set forth.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in a descriptive sense only and not for purposes of limitation, and also the technical scope of the invention is not limited to the embodiments. Furthermore, the present invention is defined not by the detailed description of the invention but by the appended claims, and all differences within the scope will be construed as being comprised in the present disclosure.

Any numbers expressed herein are to be interpreted as alternatively encompassing the exact numerical values identified set forth herein, as well as being modified in all instances by the term "about." The numerical values set forth herein are indicated as precisely as possible. Any numerical value, however, may inherently contain certain errors or inaccuracies as evident from the standard deviation found in their respective measurement techniques, which are, for example, intended to be encompassed by the modifier "about."

None of the features recited herein should be interpreted as invoking 35 U.S.C. § 112(f) unless the term "means" is explicitly used.

Many modifications will be apparent to those skilled in the art without departing from the scope of the present invention as herein described with reference to the accompanying drawings.

What is claimed is:

1. A drying arrangement for drying a body of a person, the drying arrangement comprising:

a primary drying module comprising:

a body;

a bar movable relative to the body, the bar comprising an air outlet;

a first air inlet;

a first flow generator to receive inlet air from the first air inlet and generate a primary airflow;

wherein the primary airflow is exhausted from the bar air outlet; and a secondary drying module comprising:

a housing;

a second air inlet;

a second flow generator to receive inlet air from the second air inlet and generate a secondary airflow; and a second air outlet in the housing for exhausting the secondary airflow from the second flow generator, wherein the primary drying module and the secondary drying module are configured such that, with respect to the body of the person using the drying arrangement, the primary airflow from the bar air outlet of the primary drying module and the secondary airflow from the second air outlet of the secondary drying module each:

originate from different positions about a lateral periphery of the body of the person, and are able to be directed towards a common longitudinal axis of the body of the person.

2. The drying arrangement of claim 1, wherein the drying arrangement further comprises a plurality of secondary drying modules, each of the secondary drying modules comprising an air outlet for exhausting a secondary airflow, the secondary airflows from the respective plurality of secondary drying modules originate from different positions about a lateral periphery of the body of the person, and are able to be directed towards the common longitudinal axis of the body of the person.

3. The drying arrangement of claim 2, wherein at least one of the plurality of secondary drying modules comprise an orientation mechanism operable to control an orientation of the air outlet of the secondary drying module.

4. The drying arrangement of claim 3, wherein the orientation mechanism comprises:

a controller;

a nozzle; and a motor, wherein the controller is configured to control the motor to orient the nozzle corresponding to the orientation of the air outlet of the secondary drying module.

5. The drying arrangement of claim 2, the drying arrangement further comprising a structure or an enclosure comprising a plurality of surfaces, wherein the primary drying module and the plurality of secondary drying modules are installed on a respective surface.

6. The drying arrangement of claim 5, wherein the drying arrangement comprises two secondary drying modules, and each of the primary drying module and two secondary drying modules are installed on a different one of the plurality of surfaces.

7. The drying arrangement of claim 1, wherein the first drying module further comprises a drive apparatus provided between the body and the bar, the drive apparatus configured to move the bar relative to the body so as to move a location of the bar air outlet.

8. The drying arrangement of claim 7, wherein the drive apparatus is operable to move the location of the bar air outlet along a longitudinal axis of the body of the primary drying module.

9. The drying arrangement of claim 1, wherein the body of the primary drying module further comprises:

a body inlet;

a body outlet;

a body airflow generator; and a body thermal element, wherein the body thermal element selectively conditions intake air from the body inlet, and the body airflow generator generates forced airflow to expel the selectively conditioned intake air from the body outlet.

10. The drying arrangement of claim 1, wherein the primary drying module further comprises a bar thermal element for selective conditioning the primary airflow from the bar air outlet, and the secondary drying module further comprises a secondary thermal element for selective conditioning of the secondary airflow.

11. The drying arrangement of claim 1, further comprising a controller operable to control the primary drying module and the secondary drying module to provide a cooperative drying of the body of a person.

12. The drying arrangement of claim 11, wherein the drying arrangement further comprises a plurality of controllers, one controller operable to control the primary drying module and another controller operable to control the secondary drying module, wherein the one controller and the other controller operate to synchronize the secondary drying module with the primary drying module.

13. The drying arrangement of claim 1, further comprising: a controller; and a sensor, wherein the controller is configured to determine a moisture content of the body of the person based on information from the sensor.

14. The drying arrangement of claim 1, further comprising: a controller; a first sensor associated with the primary drying module, and a second sensor associated with the secondary drying module, wherein the controller is configured to determine a moisture content of the body of the person at two different respective regions about the lateral periphery of the body of the person based on information from the first sensor and the second sensor.

15. The drying arrangement of claim 6, wherein the second air outlet of the secondary drying module is provided on a movable bar.

16. The drying arrangement of claim 15, wherein the movable bar of the secondary drying module is longitudinally movable within a guide member.

17. The drying arrangement of claim 16, wherein the secondary drying module further comprises a second drive apparatus to move the movable bar of the secondary drying module.

18. The drying arrangement claim 17, wherein the drying arrangement further comprises a plurality of controllers, one controller operable to control the drive apparatus of the primary drying module and another controller operable to control the second drive apparatus of the secondary drying module, wherein the one controller and the other controller operate to synchronize the second drive apparatus of the secondary drying module with the drive apparatus of the primary drying module.

19. The drying arrangement of claim 1, wherein the primary drying module comprises:

a pair of air inlets in the body to receive inlet air which is channeled to an upstream side of a filter unit;

a pair of body flow generators to generate a first forced airflow, each body flow generator having a first end and a second end, wherein the first end of each body flow generator is opened to a downstream side of the filter unit;

a pair of thermoelectric devices configured to control a temperature of the first forced airflow; and a first air outlet, in communication with the second end of each body flow generator, to receive the forced airflow from the body flow generators and to expel the forced airflow out of the body.

20. The drying arrangement of claim 1, the primary drying module further comprising a drive apparatus configured to movably drive the bar relative to the body, the bar further comprising:

a second pair of flow generators to generate a second forced airflow;

a pair of resistance heaters to control a temperature of the second forced airflow, wherein the second forced airflow is exhausted through the air outlet of the bar.

* * * * *